US010021468B2

(12) United States Patent
Wengreen

(10) Patent No.: US 10,021,468 B2
(45) Date of Patent: Jul. 10, 2018

(54) AUDIO SPEAKER PROTECTION SYSTEMS

(71) Applicant: Innovelis, Inc., Sammamish, WA (US)

(72) Inventor: Eric John Wengreen, Sammamish, WA (US)

(73) Assignee: Innovelis, Inc., Sammamish, WA (US)

( * ) Notice: Subject to any disclaimer, the term of this patent is extended or adjusted under 35 U.S.C. 154(b) by 0 days.

(21) Appl. No.: 15/415,717

(22) Filed: Jan. 25, 2017

(65) Prior Publication Data

US 2017/0238076 A1 Aug. 17, 2017

Related U.S. Application Data

(60) Provisional application No. 62/295,105, filed on Feb. 14, 2016.

(51) Int. Cl.
*H04R 1/02* (2006.01)

(52) U.S. Cl.
CPC ..... *H04R 1/02* (2013.01)

(58) Field of Classification Search
CPC ..... H04R 9/06; H04R 1/28; H04R 2209/022; H04R 2225/49
USPC ..... 381/334, 345, 160, 189
See application file for complete search history.

(56) References Cited

U.S. PATENT DOCUMENTS 4,949,386 A * 8/1990 Hill ..... H04R 1/026 381/349
2004/0159490 A1* 8/2004 Marlin ..... H04R 9/02 181/148
2015/0036863 A1* 2/2015 Wen ..... F21V 23/009 381/386
2015/0125002 A1* 5/2015 Van Den Nieuwenhuizen ..... H01H 19/635 381/109

* cited by examiner

*Primary Examiner* — Suhan Ni

(57) ABSTRACT

Speaker protection systems can be configured to protect audio speakers from falls. In some embodiments, systems include a bottom cap coupled to a bottom portion of the speaker device. Systems can also include a top cap coupled to a top portion of the speaker device. The top cap can cover part of a top surface of the speaker device such that the top cap is configured to resist downward dislodgement of the top cylindrical cap. The top cap can be rotatably coupled to the bottom cap. Embodiments can enable variable shock absorption with resistance to deformation that increases as the magnitude of the deformation increases. This approach can maximize odds of speakers "surviving" falls from substantial heights.

18 Claims, 26 Drawing Sheets

AUDIO SPEAKER PROTECTION SYSTEMS

CROSS-REFERENCE TO RELATED APPLICATIONS

The entire contents of the following application are incorporated by reference herein: U.S. Provisional Application No. 62/295,105, filed on Feb. 14, 2016, and titled AUDIO SPEAKER PROTECTION SYSTEMS.

BACKGROUND

Field

Various embodiments disclosed herein relate to systems and methods to protect speaker devices. Certain embodiments relate to protective housings for speaker devices.

Description of Related Art

Dropping an audio speaker often damages the speaker. Speakers with external moving parts are particularly hard to protect from damage caused by falls because protection systems can impede normal use of the speaker (e.g., by impeding access to moving parts). As a result, many people simply do not use a protection system. Some people use a protection system that fails to even attempt to protect the external moving portions, which leaves the speaker vulnerable to damage caused by falls. Thus, there is a need for systems that provide reliable protection from falls.

SUMMARY

In some embodiments, speaker protection systems are uniquely configured to enable moving parts to be protected when audio speakers are dropped. Various features work together to absorb impacts from falls. The interaction of these features enable speaker protection systems to be compliant during initial phases of impact and then reduce compliance to avoid "bottoming out" problems, which often lead to speaker damage. Thus, embodiments can enable variable shock absorption with resistance to deformation that increases as the magnitude of the deformation increases. This approach can maximize odds of speakers "surviving" falls from substantial heights (e.g., as defined by U.S. Military Standards such as MIL-STD-810G).

In several embodiments, a speaker protection system is configured to protect an audio speaker device from falls. The system can include a bottom cap coupled to a bottom portion of the speaker device. The bottom cap can be cylindrical and can have a hole that is concentric with an outer cylindrical surface of the bottom cap. A top cap can be coupled to a top portion of the speaker device. The top cap can also be cylindrical (or any other suitable shape). The top cap can have a hole that is concentric with an outer perimeter of the top cap. The top cap can cover at least a portion of a top surface of the speaker device such that the top cylindrical cap is configured to resist downward dislodgement of the top cylindrical cap.

In some embodiments, the top cap is coupled to the bottom cap such that the top cap can rotate relative to the bottom cap. The system can be coupled to the speaker device by inserting a bottom portion of the speaker device into a first cavity of the bottom cap, inserting a top portion of the speaker device into a second cavity of the top cap, and coupling the top cap to the bottom cap (e.g., via a snap fit).

In several embodiments, the system can be removed from the speaker device by decoupling the top cap from the bottom cap, sliding the top cap upward (until it is no longer on the speaker device), and sliding the bottom cap downward (until it is no longer on the speaker device).

In some embodiments, ventilation channels help with heat management and with shock absorption. Ventilation channels can be oriented vertically and can be formed by ribs. Ribs can be radially inward protrusions that are separated by valleys. In some embodiments, the ribs are oriented radially inward around an inward facing cylindrical surface of the top cap and/or the bottom cap.

In several embodiments, the top cap, the bottom cap, and/or the speaker device are concentric. The top cap and the bottom cap can have equal outer diameters. In some embodiments, the top cap has a larger outer diameter than the bottom cap to provide additional shock absorption when the speaker device tips over.

BRIEF DESCRIPTION OF THE DRAWINGS

These and other features, aspects, and advantages are described below with reference to the drawings, which are intended to illustrate but not to limit the invention. In the drawings, like reference characters denote corresponding features consistently throughout similar embodiments.

FIG. 3 also illustrates a top cylindrical cap moving downward towards a top portion of the speaker device in preparation to insert a top end of the speaker device into a cavity of the top cylindrical cap, according to some embodiments.

DETAILED DESCRIPTION

Figure 1:
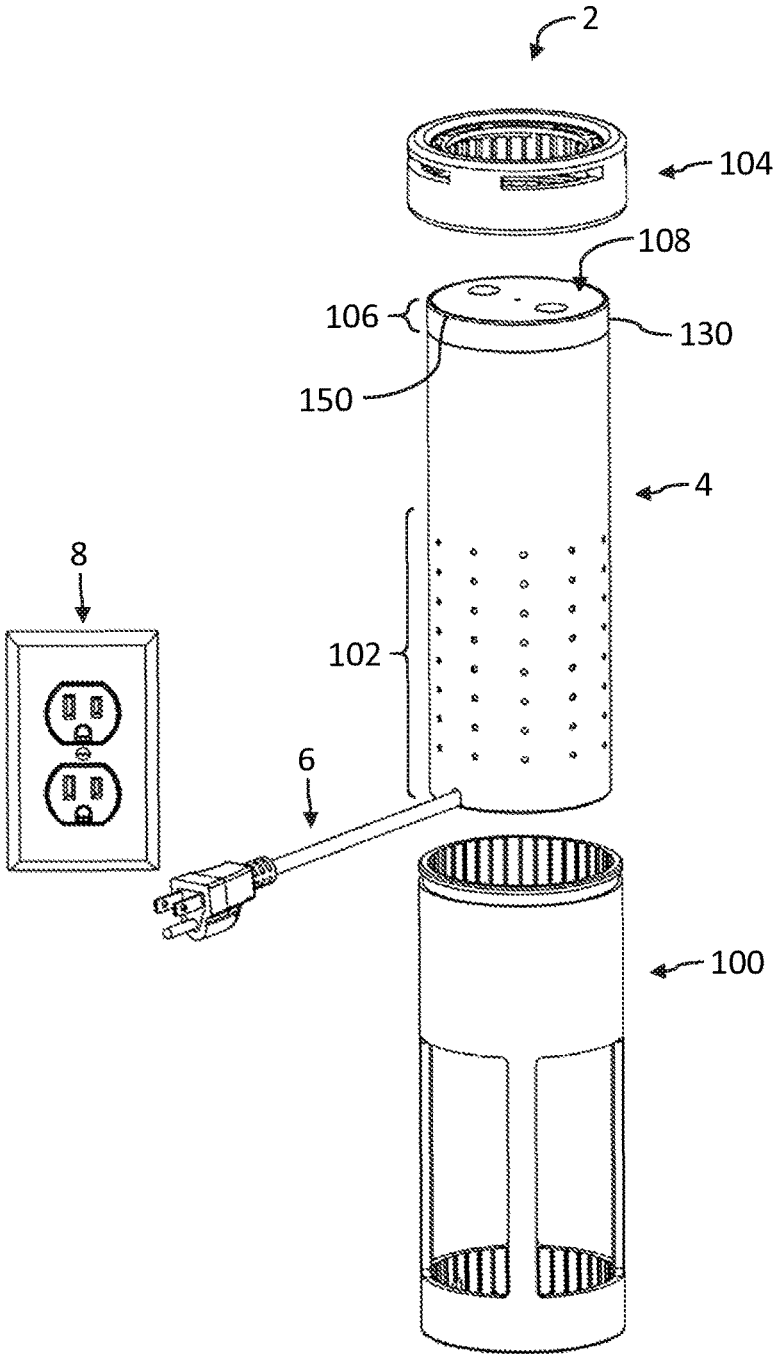
FIG. 1 illustrates a perspective view of a system configured to protect an audio speaker device from falls, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein. The features of each embodiment can be combined with the other embodiments.

In some embodiments, speaker protection systems are uniquely configured to enable moving parts to be protected when audio speakers are dropped. Various features work together to absorb impacts from falls. The interaction of these features enable speaker protection systems to be compliant during initial phases of impact and then reduce compliance to avoid "bottoming out" problems, which often lead to speaker damage. Thus, embodiments can enable variable shock absorption with resistance to deformation that increases as the magnitude of the deformation increases. This approach can maximize odds of speakers "surviving" falls from substantial heights (e.g., as defined by U.S. Military Standards such as MIL-STD-810G).

In several embodiments, the speaker device 4 is an Amazon Echo made by Amazon.com, Inc. The speaker device 4 can be a cylinder. Other types of speaker devices 4 can also be used with embodiments of speaker protection systems 2.

Speakers with external moving parts are particularly hard to protect from damage caused by falls because protection systems can impede normal use of the speaker. The Amazon Echo includes a rotating dial (e.g., 130 in FIG. 2) that moves relative to a lower portion of the Amazon Echo. Many prior art protection systems failed to even attempt to protect the upper portion of Amazon Echo because doing so would hinder moving the rotating dial 130. As a result, the prior art systems leave the speaker device 4 vulnerable to falls in which the speaker device 4 lands on the top portion 106.

Many embodiments described herein solve this problem via a rotatable coupling 125 that enables a top cap 104 to rotate relative to the bottom cap 100 while the top cap 104 applies a compressive force on the rotating dial 130. The compressive force enable the top cap 104 to rotate the dial 130 in response to a user rotating the top cap 104. The resulting system 2 provide far superior speaker protection than systems that fail to cover the top portion 106 of the speaker 4. In addition, the system 2 preserves access to the functionality of the rotating dial 130 (although indirectly via the top cap 104).

In many embodiments, the top cap 104 can be coupled to the bottom cap 100 by pressing the top cap 104 onto the bottom cap 100. This pressing force can deform portions of the top cap 104 and/or the bottom cap 100 to activate and engage a snap fit. In several embodiments, snap-fits use flexible parts (which can be molded from plastic, rubber, or any suitable material) to form the final assembly by pushing the parts' interlocking components together.

Some embodiments of the system 2 comprise an interlock 110 between the top cylindrical cap 104 and the bottom cylindrical cap 100. The interlock 110 can comprise a downward facing wall 112 of the bottom cylindrical cap 100 that blocks upward movement of the top cylindrical cap 104 relative to the bottom cylindrical cap 100, but does not block rotational movement 119 of the top cylindrical cap 104 relative to the bottom cylindrical cap 100. Thus, the system 2 is configured to enable the top cap 104 to rotate relative to the bottom cap 100 while impeding the top cap 104 from being uncoupled from the bottom cap 100.

As used herein, a vertical direction is oriented along a central axis of the caps. When the top cap is coupled to the bottom cap, downward is a direction from the top cap towards the bottom cap and upward is a direction from the bottom cap towards the top cap. A downward facing wall is oriented within plus or minus 25 degrees of parallel to a central axis of the cap that comprises the downward facing wall. An upward facing wall is oriented within plus or minus 25 degrees of parallel to a central axis of the cap that comprises the upward facing wall.

The caps can be cylindrical. In some embodiments, the caps are not cylindrical, but can be any suitable shape. For example, the caps can have cross sections that are square, rectangle, or hexagonal.

As used herein, an interlock is a structure or set of structures that couple two parts such that the motion or operation of at least one of the parts is constrained by the other part. In some embodiments, interlocks allow two parts to rotate relative to each other, but limit how far apart the two parts can move away from each other. For example, the interlock may prevent the two parts from moving more than 15 millimeters away from each other.

Figure 7:
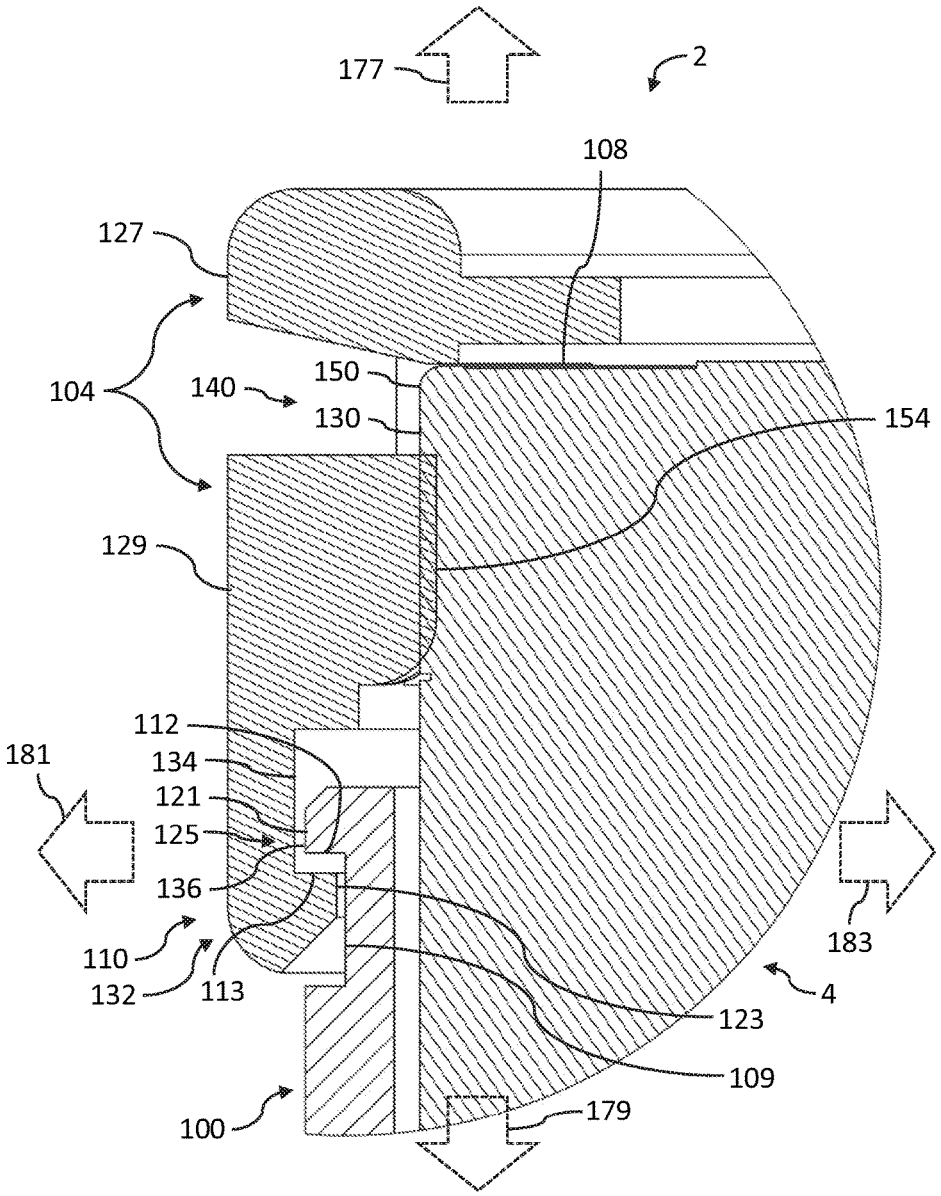
FIG. 7 illustrates a partial view of the area indicated by circle G in FIG. 6, according to some embodiments.
Figure 8:
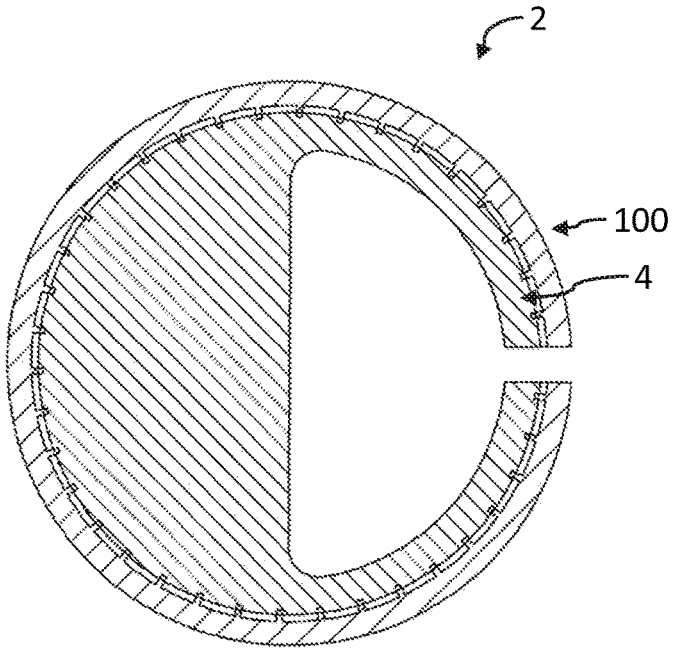
FIG. 8 illustrates a cross-sectional view along line B-B in FIG. 5, according to some embodiments.
Figure 9:
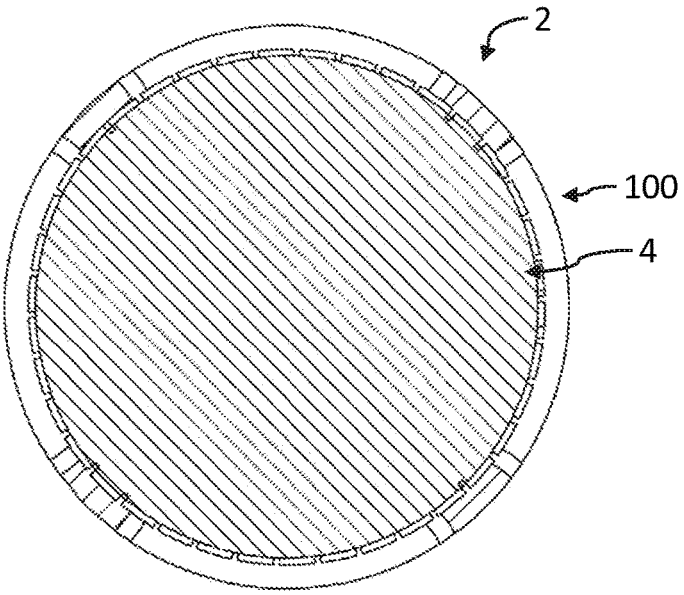
FIG. 9 illustrates a cross-sectional view along line C-C in FIG. 5, according to some embodiments.
Figure 10:
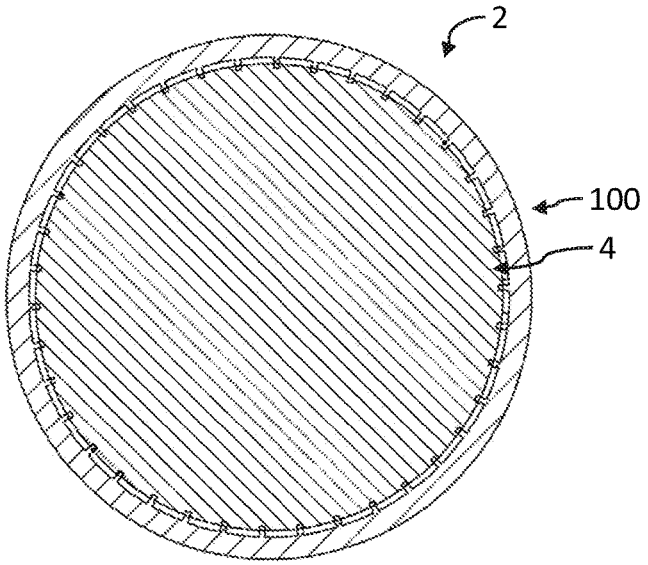
FIG. 10 illustrates a cross-sectional view along line D-D in FIG. 5, according to some embodiments.
Figure 11:
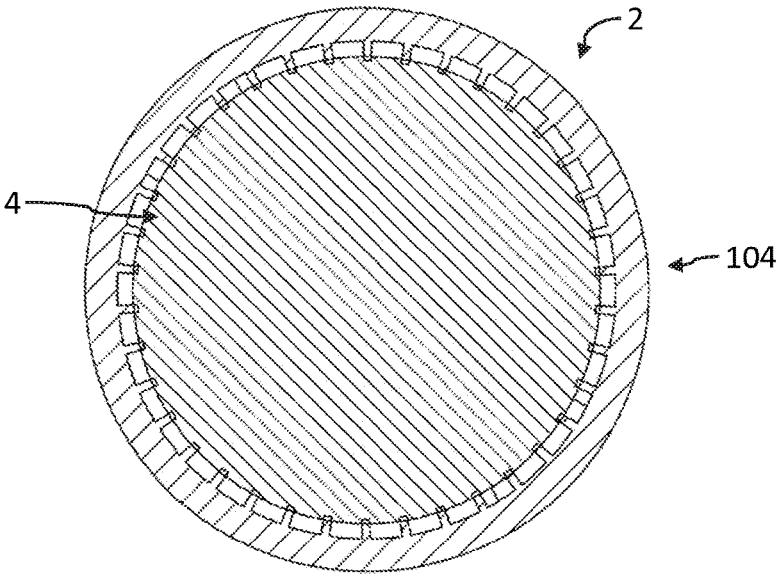
FIG. 11 illustrates a cross-sectional view along line E-E in FIG. 5, according to some embodiments.
Figure 12:
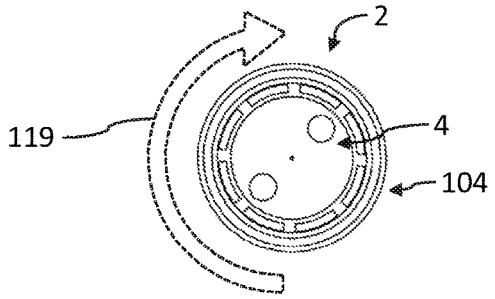
FIG. 12 illustrates a top view of the system configured to protect the audio speaker device from falls, according to some embodiments.
Figure 13:
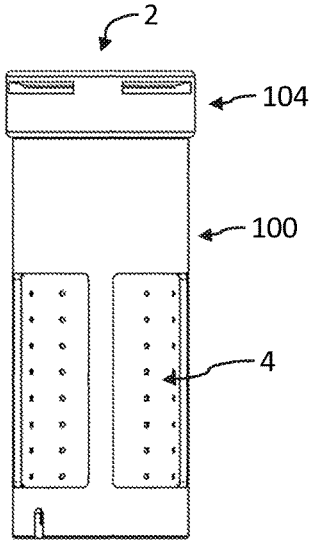
FIG. 13 illustrates a back view of the system configured to protect the audio speaker device from falls, according to some embodiments.
Figure 14:
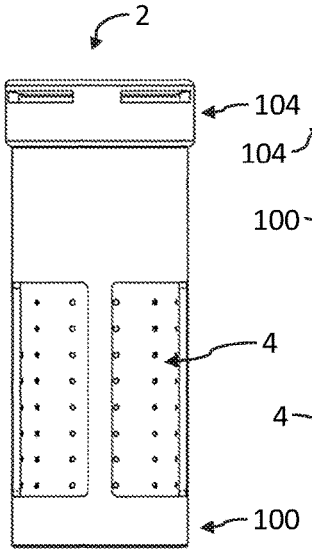
FIG. 14 illustrates side view of the system configured to protect the audio speaker device from falls, according to some embodiments.
Figure 15:
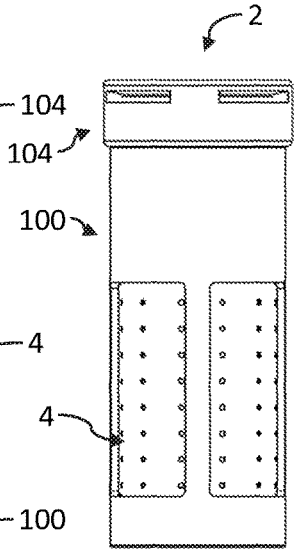
FIG. 15 illustrates a front view of the system configured to protect the audio speaker device from falls, according to some embodiments.
Figure 16:
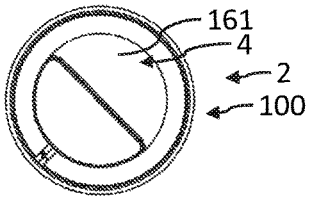
FIG. 16 illustrates a bottom view of the system configured to protect the audio speaker device from falls, according to some embodiments.
Figure 17:
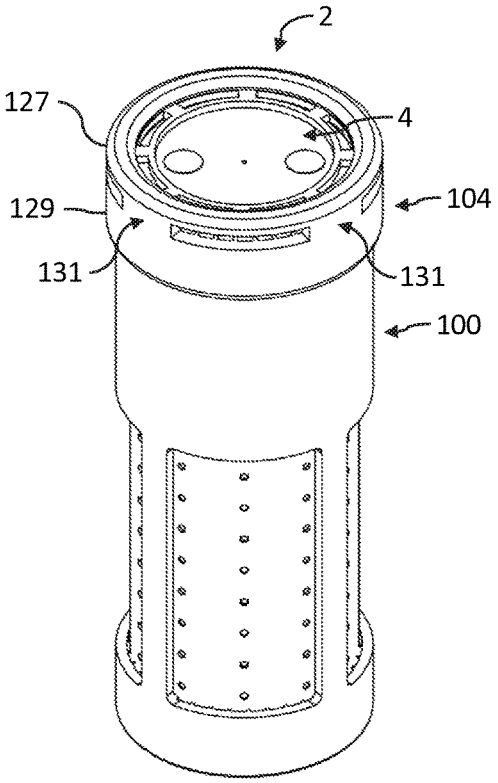
FIGS. 17 and 18 illustrate perspective views of the system configured to protect the audio speaker device from falls, according to some embodiments.
Figure 18:
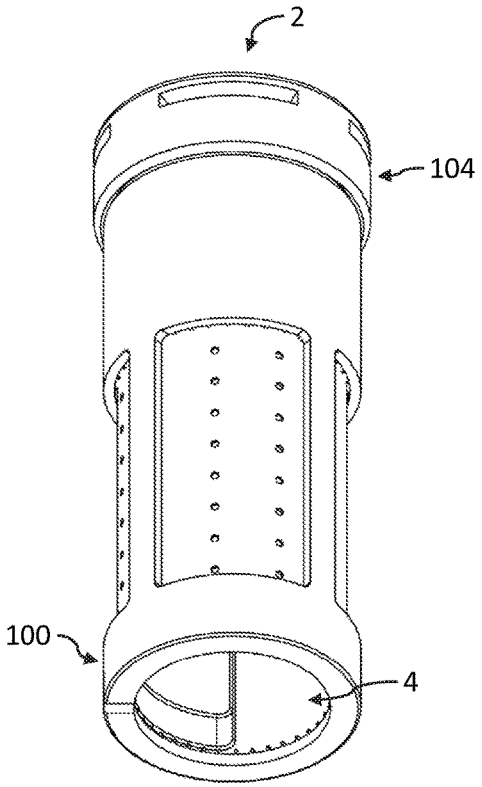
Figure 19:
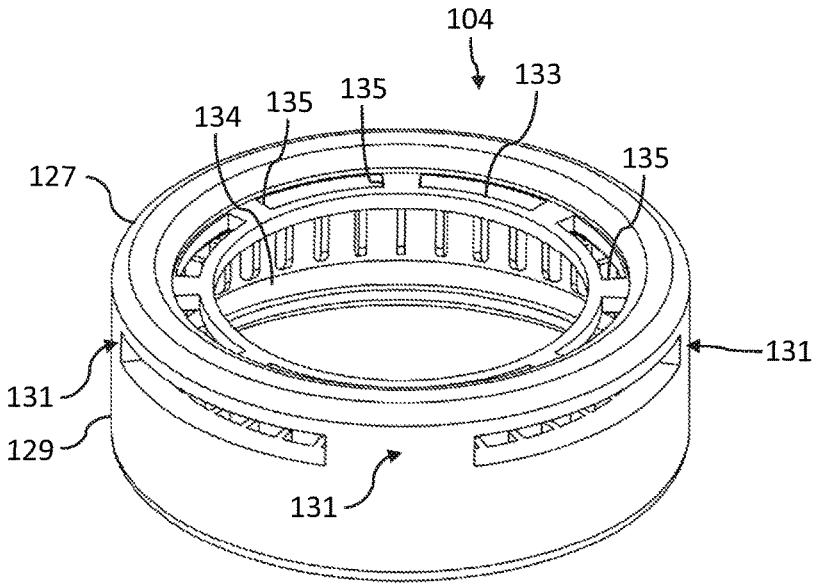
FIG. 19 illustrates a top and first side perspective view of the top cylindrical cap (shown in FIG. 1) configured to protect the audio speaker device from falls, according to some embodiments.
Figure 20:
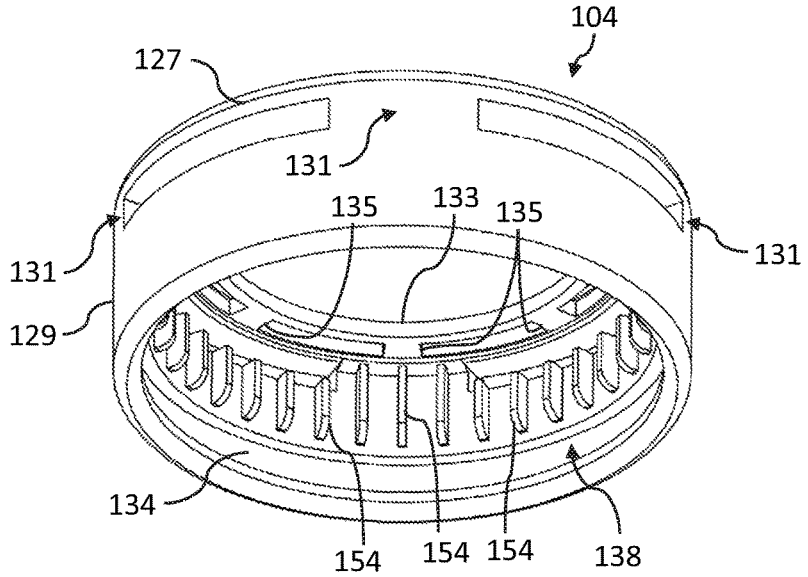
FIG. 20 illustrates a bottom and first side perspective view of the top cylindrical cap, according to some embodiments.
Figure 21:
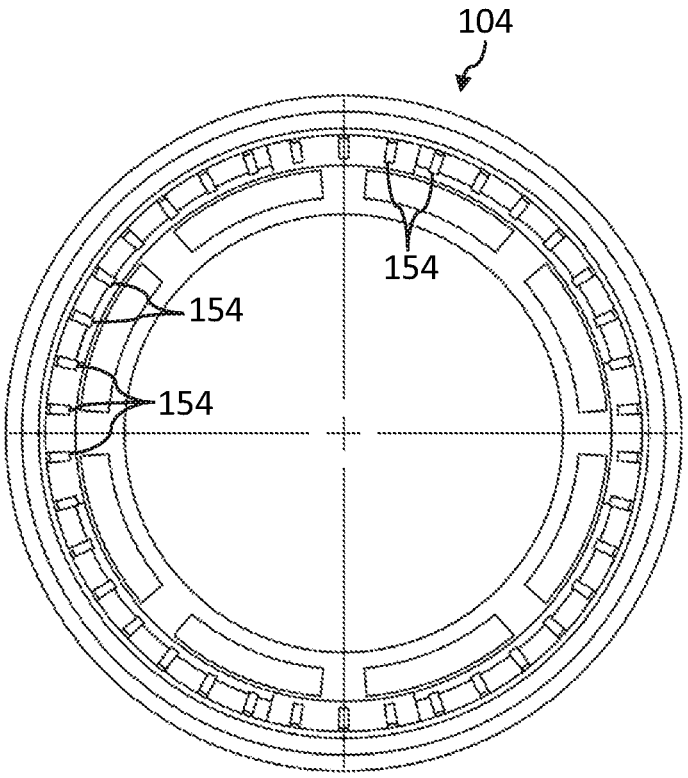
FIG. 21 illustrates a bottom view of the top cylindrical cap, according to some embodiments.
Figure 22:
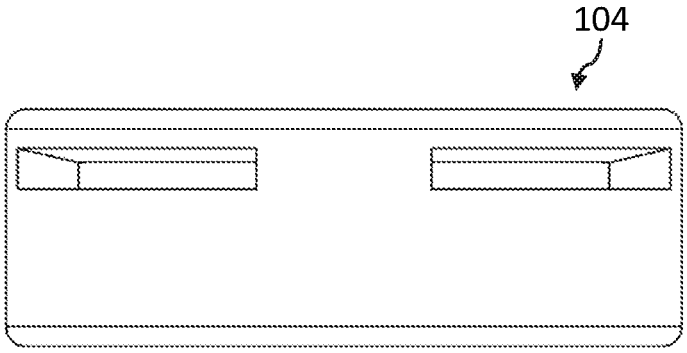
FIG. 22 illustrates a second side view of the top cylindrical cap, according to some embodiments.
Figure 23:
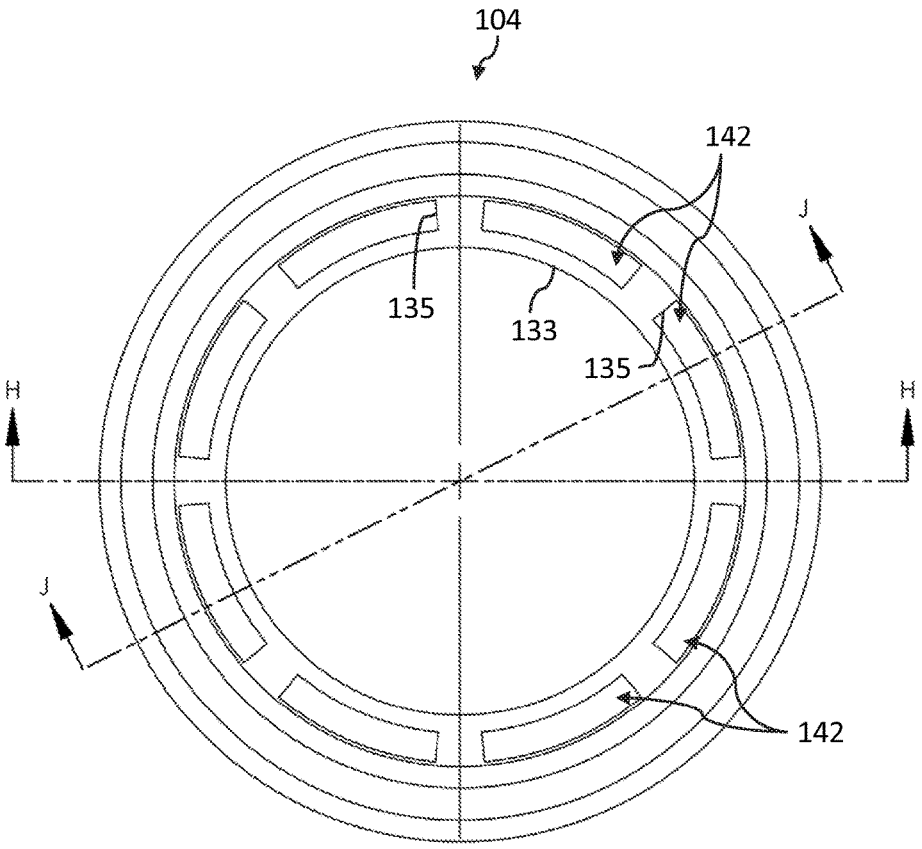
FIG. 23 illustrates a top view of the top cylindrical cap, according to some embodiments.
Figure 24:
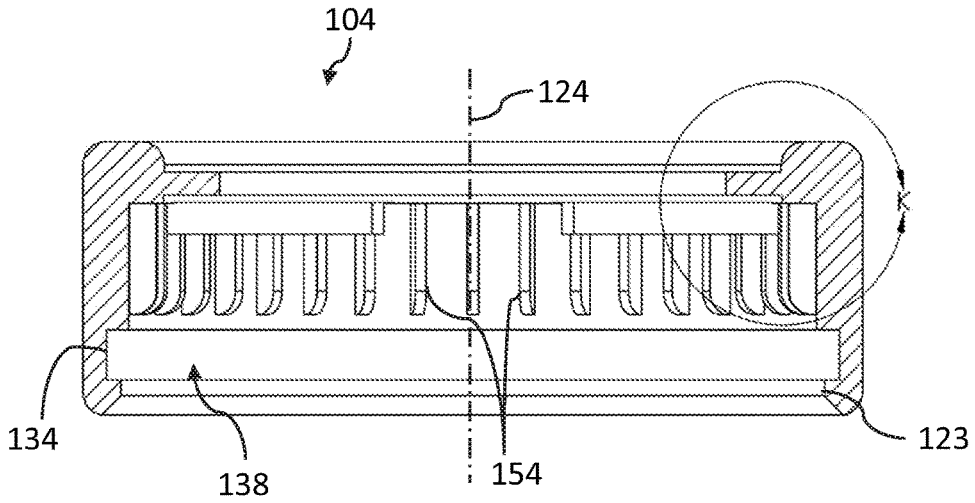
FIG. 24 illustrates a cross-sectional view along line H-H in FIG. 23, according to some embodiments.

As used herein, "block" refers to a physical relationship between mechanical structures. In many embodiments, the blocking can be overcome by sufficient upward force or downward force to remove the top cap 104 from the bottom cap 100. Referring now to FIG. 7, a downward facing wall 112 of the bottom cap 100 blocks an upward facing wall 113 of the top cap 104 from moving upward (e.g., as indicated by arrow 177). However, applying a sufficient upward force on the top cap 104 will cause portions of the top tap 104 and/or the bottom cap 100 to deform (e.g., elastically) to enable removing the top cap 104 from the bottom cap 100 to facilitate removing the speaker device 4 from the system 2. Thus, the top cap 104 is detachably coupled to the bottom cap 100.

Similarly, a radially outward protrusion 121 of the bottom cap 100 blocks a radially inward protrusion 123 of the top cap 104 from moving upward (e.g., as indicated by arrow 177). However, applying a sufficient upward force on the top cap 104 will cause portions of the top tap 104 and/or the bottom cap 100 to deform (e.g., elastically) to enable removing the top cap 104 from the bottom cap 100 to facilitate removing the speaker device 4 from the system 2.

In some embodiments, the vertical interlock 110 blocks upward movement of the top cylindrical cap 104 relative to the bottom cylindrical cap 100, but then permits the user to move the top cap 104 upwards relative to the bottom cap 100 to remove the top cap 104 from the bottom cap 100 during disassembly of the system 2.

In several embodiments, the vertical interlock 110 can comprise a downward facing wall 112 of the bottom cylindrical cap 100 that blocks upward movement of the top cylindrical cap 104 relative to the bottom cylindrical cap 100. In these same embodiments, the vertical interlock 110 removably couples the top cylindrical cap 104 to the bottom cylindrical cap 100 such that pulling the top cylindrical cap 104 upward relative to the bottom cylindrical cap 100 can overcome a holding force of the vertical interlock 110, which causes elastic deformation of at least a portion of the top cylindrical cap 104 relative to the bottom cylindrical cap 100 to release the vertical interlock 110.

Another challenge that speakers 4 face is heat management. Speakers 4 can generate a lot of heat, especially during high-volume operation. Several embodiments include ribs 154, 156, 158 to form vents 155, 157 to permit cooling air to flow between the caps 100, 104 and the speaker 4. The ribs 154, 156, 158 also add compliance to the system to improve shock absorption performance. The ribs 154, 156, 158 can provide a lower resistant to deformation than a solid wall (e.g., of rubber) to which the ribs 154, 156, 158 are coupled. Thus, the system 2, can initially deform relatively easily during an impact, and then, the system can having a higher resistance to deformation.

In some embodiments, ventilation channels 155, 157 help with heat management and with shock absorption. Ventilation channels 155, 157 can be oriented vertically and can be formed by ribs 154, 156, 158. Ribs 154, 156, 158 can be thin protrusions that are separated by valleys. Ribs 154, 156 can be less than 7 millimeters wide and can protrude radially inward between 0.5 millimeters and 10 millimeters.

Figure 32:
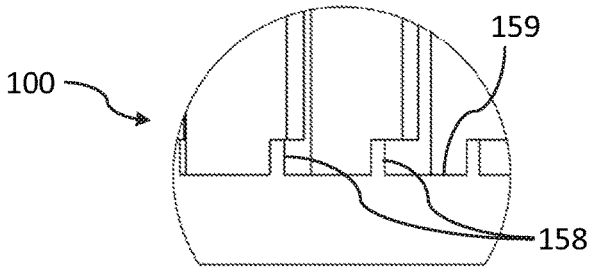
FIG. 32 illustrates a partial view of the area indicated by circle P in FIG. 31, according to some embodiments.
Figure 33:
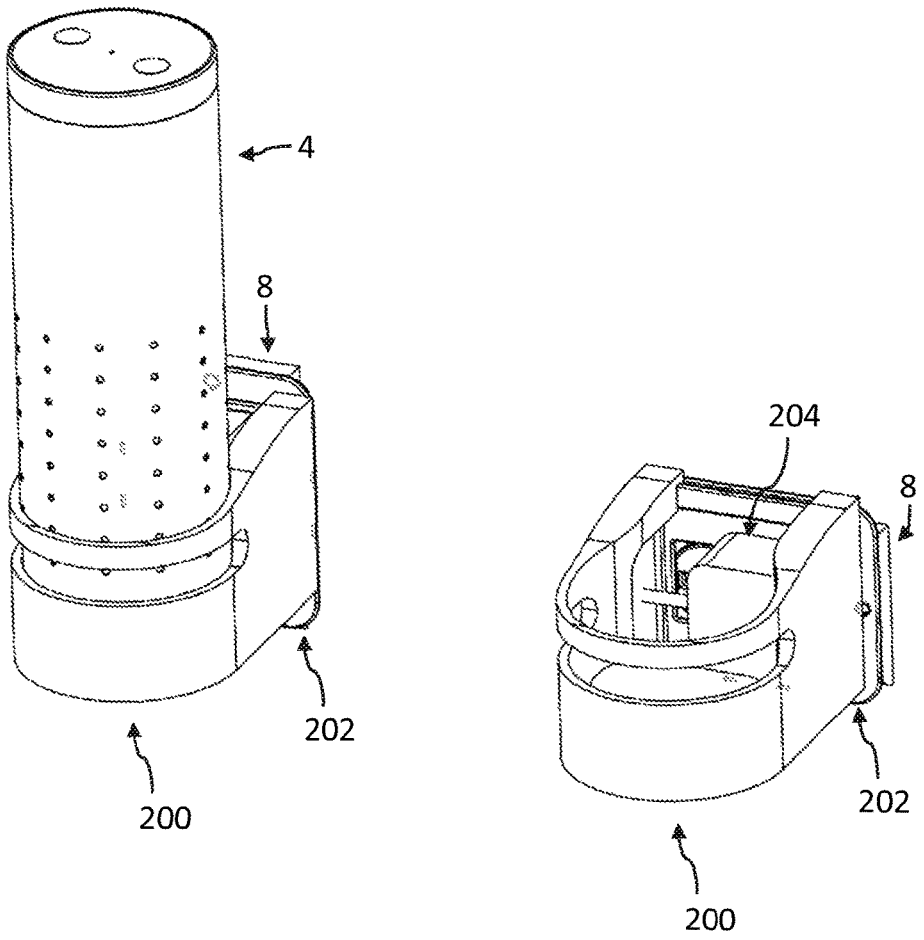
FIG. 33 illustrates a perspective view of two mounts configured to couple a speaker device to a power outlet, according to some embodiments.
Figure 34:
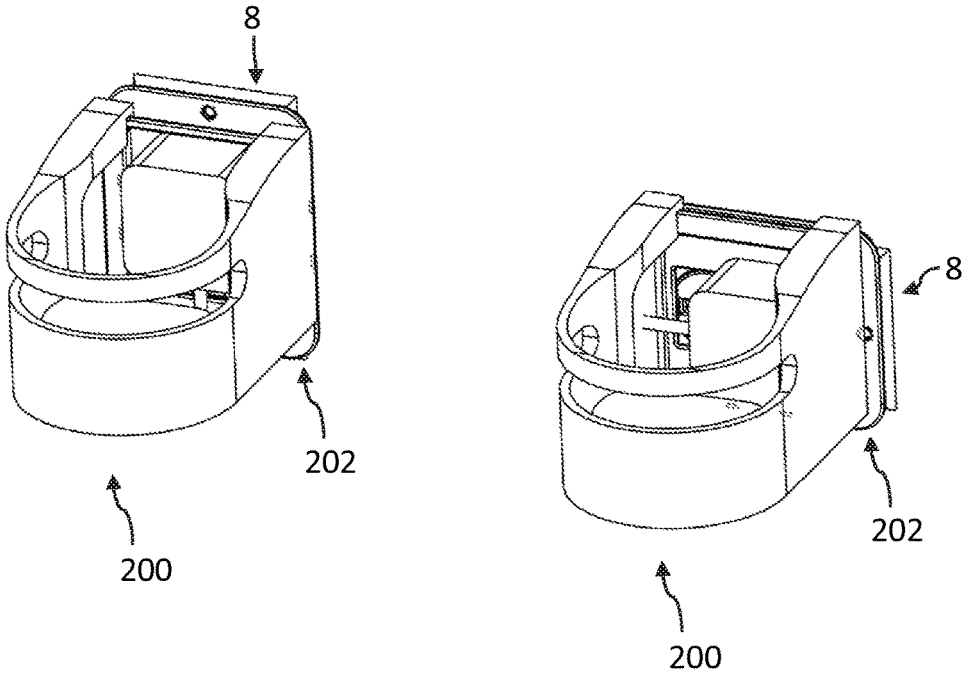
FIG. 34 illustrates a perspective view of a mount coupled to a vertical power outlet and a mount coupled to a horizontal power outlet, according to some embodiments.
Figure 35:
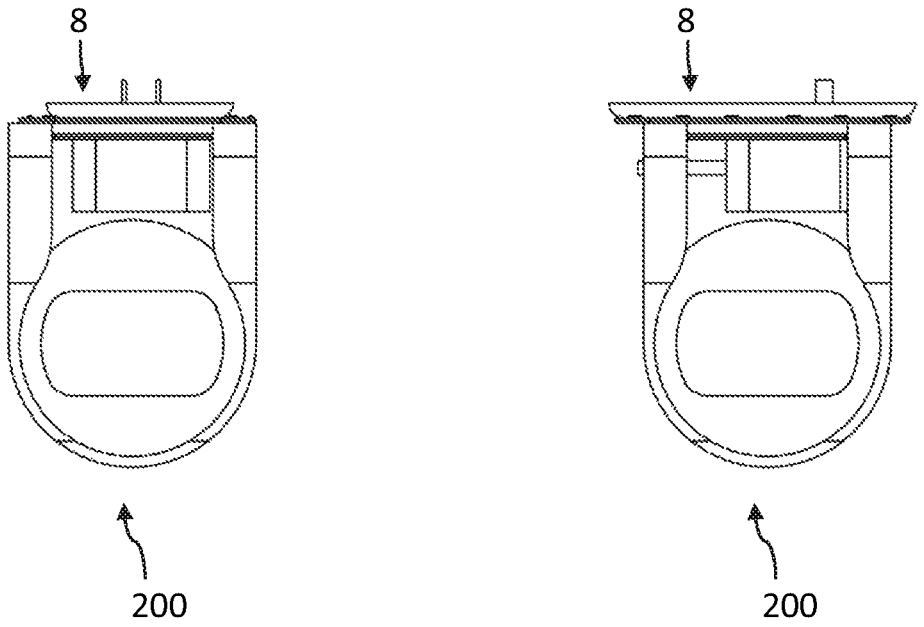
FIG. 35 illustrates a top view of a mount coupled to a vertical power outlet and a mount coupled to a horizontal power outlet, according to some embodiments.
Figure 36:
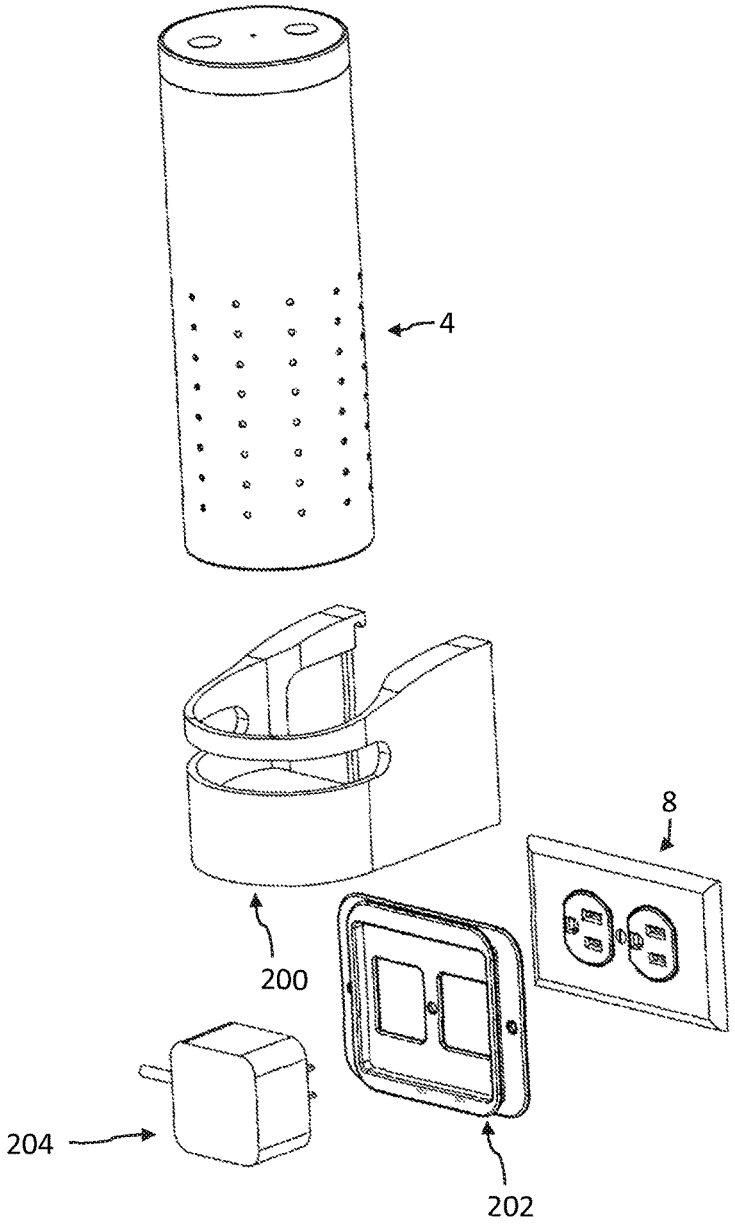
FIG. 36 illustrates an exploded, perspective view of a mount configured to couple a speaker device to power outlet, according to some embodiments.

As shown in FIG. 32, ribs 158 can be less than 7 millimeters wide and can protrude upward (e.g., towards the top cap 104) between 0.5 millimeters and 10 millimeters. A ventilation channel can be located between adjacent ribs 158.

Some embodiments use an interference fit. As used herein, the term "interference fit" is used broadly. In several embodiments, an interference fit, also known as a press fit or friction fit, is a fastening (which is often detachable) between two parts which can be achieved by friction after the parts are pushed together.

In some embodiments, an interference fit is when a first part is larger than a second part such that inserting the first part into the second part causes the second part to expand or causes the first part to contract. FIG. 7 shows how a rib 154 of the top cap 104 interferes with the rotating dial 130. In FIG. 7, the rib 154 appears to penetrate into the rotating dial 130. In reality, however, the rib 154 deforms radially outward (e.g., buckles in a random orientation) in response to inserting the rotating dial 130 into the cavity of the top cap 104 that includes the rib 154. This interference fit enables the top cap 104 to "grip" the rotating dial 130. In several embodiments, the rib 154 is coupled to the rotating dial 130 without touching lower portions of the speaker 4 (e.g., to reduce drag as the dial 130 is rotated relative to the rest of the speaker 4).

Speakers 4 can be far heavier than other electrics (e.g., cellphones). As a result, some prior art system have failed to provide adequate fall protection. The rings 127, 129, and 133 coupled by pillars 131 and radial protrusions 135 provide remarkable shock protection, even for heavy speakers (such as the Amazon Echo). These components work together to provide a unique blend of initial softness (to take the "edge" off the initial impact) followed by increasing resistance to deformation and ultimately robust resilience. As a result, the rings 127, 129, and 133 coupled by pillars 131 and radial protrusions 135 are particularly well-suited to protect the fragile top portion 160 of the Amazon Echo.

Figure 6:
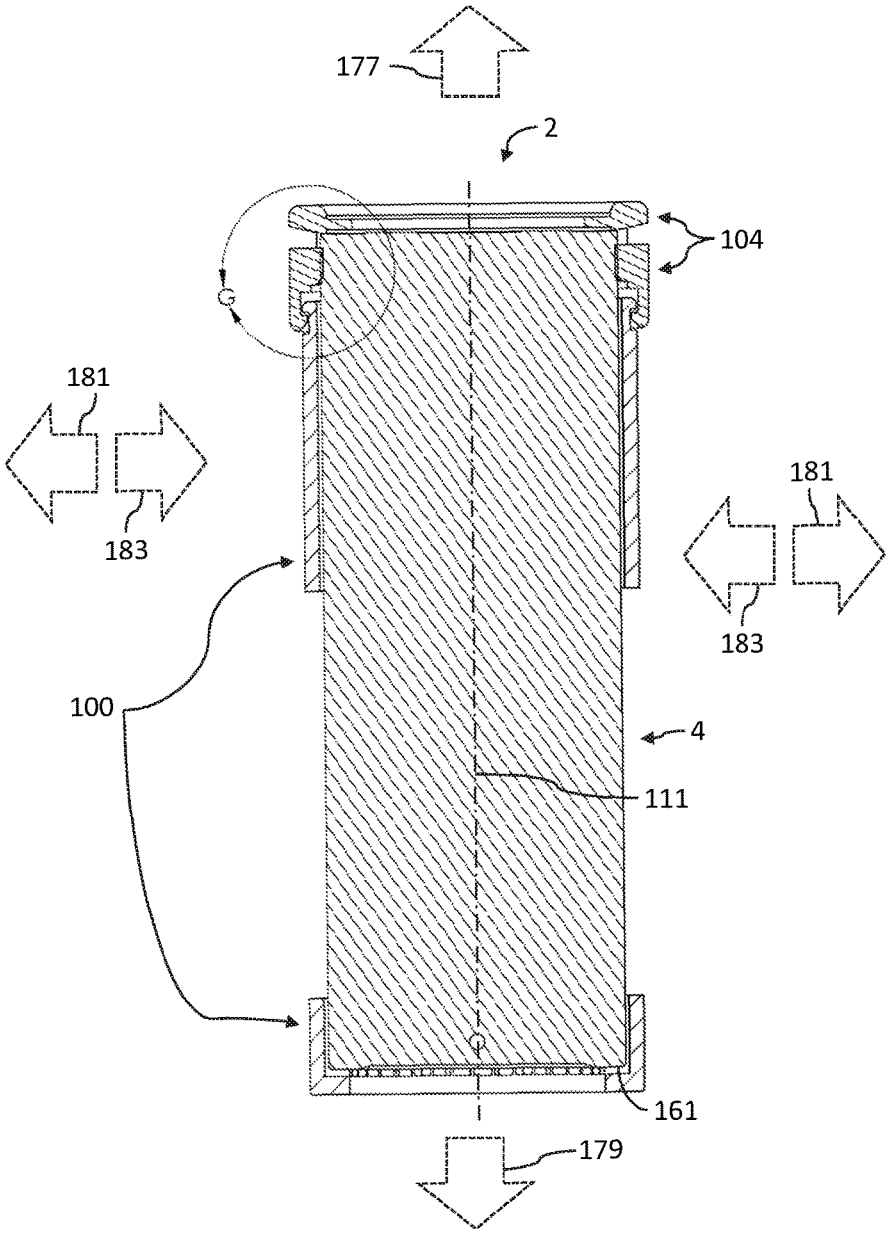
FIG. 6 illustrates a cross-sectional view along line A-A in FIG. 5, according to some embodiments.

FIGS. 6 and 7 illustrate an upward arrow 177 and a downward arrow 179, which are oriented vertically. An arrow 181 illustrates radially outward and an arrow 183 illustrates radially inward (relative to a central axis 111 of the system 2).

As used herein, a surface can be at an angle (between plus or minus 35 degrees) relative to a plane that is perpendicular to the central axis 111 of the system 2 and still face upward or downward. For example, an upward-facing surface can be oriented at an angle of plus or minus 35 degrees relative to the plane that is perpendicular to the central axis 111 of the system 2 and still face upward relative to the central axis 111 of the system 2. A downward-facing surface can be oriented at an angle of plus or minus 35 degrees relative to the plane that is perpendicular to the central axis 111 of the system 2 and still face downward relative to the central axis 111 of the system 2.

As used herein, a protrusion is radially inward even if the protrusion is not directly radially inward. Directly radially inward means directly towards a central axis 111 of the system 2. In some embodiments, features such as ribs 154, 156 protrudes radially inward because they protrude towards a central area of the top cap 104 and/or the bottom cap 100, and yet do not protrude directly radially inward. Ribs 154, 156 can protrude radially inward by protruding into a central cavity of the top cap 104 and/or the bottom cap 100.

Features can protrude radially outward by protruding away from the central area of the top cap 104 and/or the bottom cap 100 without necessarily protruding directly radially outward. In several embodiments, radially outward protrusions 121 protrude outward at an angle relative to a plane that is perpendicular to the central axis 111 of the system 2. Ribs 154, 156 can protrude radially outward by protruding away from a central cavity of the top cap 104 and/or the bottom cap 100.

The bottom cap 100 can include a groove 109 that faces radially outward (e.g., as shown by arrow 181 in FIG. 7). At least a portion of a radially inward protrusion 123 of the top cap 104 can be located in the groove 109 of the bottom cap 100. The groove 109 can be at least 1 millimeter and/or less than 10 millimeters taller (measured in an upward direction as indicated by arrow 177) than the protrusion 123 to reduce drag and friction to facilitate easy rotation of the top cap 104 relative to the bottom cap 100. In several embodiments, the radially inward protrusion 123 of the top cap 104 is configured to not touch the groove 109 of the bottom cap 100 as the top cap 104 rotates relative to the bottom cap 100 while the groove 109 releasably blocks the top cap 104 from detaching from the bottom cap 100.

Although many embodiments are described as being cylindrical, not all embodiments are cylindrical. In some embodiments, the bottom cap and the top cap are cubes. In several embodiments, the bottom and top caps have triangular cross-sections. The caps can have any suitable shape.

Many of the embodiments can be molded from silicone. Some embodiments are molded from acrylonitrile butadiene styrene ("ABS"), thermoplastic elastomer ("TPE"), thermoplastic polyurethane ("TPU"), polyurethane ("PU"), and/or polycarbonate ("PC"). In several embodiments, a first material is molded, and then a softer material is overmolded onto the first material. For example, the outer material of caps can be harder than the inner material. In several embodiments, the ribs are overmolded from a softer material than is used to mold exterior portions of the caps.

Textures and surface features (such as ridges) can be molded into external surfaces of caps to make the caps less likely to slip out of people's hands. The cap walls can have any suitable thickness. In some embodiments, the cap walls are at least 0.5 millimeters thick and/or less than 15 millimeters thick.

Not all items are labeled in each figure. The items shown in FIG. 1 are shown in more detail in FIGS. 2-32.

FIGS. 1-32 illustrate various features of a speaker protection system 2 configured to protect an audio speaker device 4 from falls. The system can comprise a bottom cylindrical cap 100 coupled to a bottom portion 102 of the speaker device 4; and a top cylindrical cap 104 coupled to a top portion 106 of the speaker device 4. The top cylindrical cap 104 can cover at least a portion of a top surface 108 of the speaker device 4 such that the top cylindrical cap 104 is configured to resist downward dislodgement of the top cylindrical cap 104. The bottom cylindrical cap 100 is configured to resist movement relative to the bottom portion 102. The top cylindrical cap 104 is configured to resist movement relative to the top portion 106. The top cylindrical cap 104 is rotatably coupled to the bottom cylindrical cap 100.

The system can comprise a vertical interlock 110 (e.g., as illustrated in FIG. 7) between the top cylindrical cap 104 and the bottom cylindrical cap 100. The vertical interlock 110 comprises a downward facing wall 112 of the bottom cylindrical cap 100 that blocks upward movement of the top cylindrical cap 104 relative to the bottom cylindrical cap 100, but does not block rotational movement 119 of the top cylindrical cap 104 relative to the bottom cylindrical cap 100. The downward facing wall 112 follows a 360 degree path around a central axis 122 of the bottom cylindrical cap 100.

The vertical interlock 110 can comprise an upward facing wall 113 of the top cylindrical cap 104. The downward facing wall 112 faces the upward facing wall 113 of the top cylindrical cap 104. Upward movement (e.g., as indicated by arrow 177 in FIG. 6) of the top cylindrical cap 104 relative to the bottom cylindrical cap 100 causes the upward facing wall 113 to collide with the downward facing wall 112 to impede further upward movement of the top cap 104 relative to the bottom cap 100. The upward facing wall 113 follows a 360 degree path around a central axis 124 of the top cylindrical cap 104

In some embodiments, the top cap 104 is removably coupled to the bottom cap 100 such that a sufficiently large force can overcome the maximum holding strength of the interlock 110, which causes the interlock 110 to elastically deform, which permits decoupling the top cap 104 from the bottom cap 100, which permits removing the speaker device 4 from the top cap 104 and the bottom cap 100.

Referring now to FIG. 7, the interlock 110 removably couples the top cylindrical cap 104 to the bottom cylindrical cap 100 such that pulling the top cylindrical cap 104 upward relative to the bottom cylindrical cap 100 overcomes a holding force of the vertical interlock 110, which causes elastic deformation of at least a portion of the top cylindrical cap 104 relative to the bottom cylindrical cap 100 to release the vertical interlock 110.

The vertical interlock 110 is located indirectly below a rotating dial 130 of the speaker device 4. (FIG. 1 also illustrates the rotating dial 130.) The top cylindrical cap 104 comprises a first interference fit with the rotating dial 130.

The top cylindrical cap 104 is rotatably coupled to the bottom cylindrical cap 100 by a snap fit 132 comprising a radially outward protrusion 121 and a radially inward protrusion 123 such that at least a portion of the snap fit 132 elastically deforms in response to coupling the top cylindrical cap 104 to the bottom cylindrical cap 100.

The top cylindrical cap 104 comprises a groove 134 that faces radially inward. The bottom cylindrical cap 100 comprises a radially outward protrusion 121 located at least partially in the groove 134. The top cylindrical cap 104 is rotatably coupled to the bottom cylindrical cap 100 by the groove 134 and the radially outward protrusion 121.

The snap fit 132 is located indirectly below a rotating dial 130 of the speaker device 4. The top cylindrical cap 104 comprises a first interference fit with the rotating dial 130. The groove 134 is configured to rotate without contacting a radially outward most surface 136 of the radially outward protrusion 121.

The groove 134 follows a 360 degree path along an inner-facing wall 138 of the top cylindrical cap 104. The radially outward protrusion 121 follows a 360 degree path around a central axis 122 of the bottom cylindrical cap 100.

Figure 3:
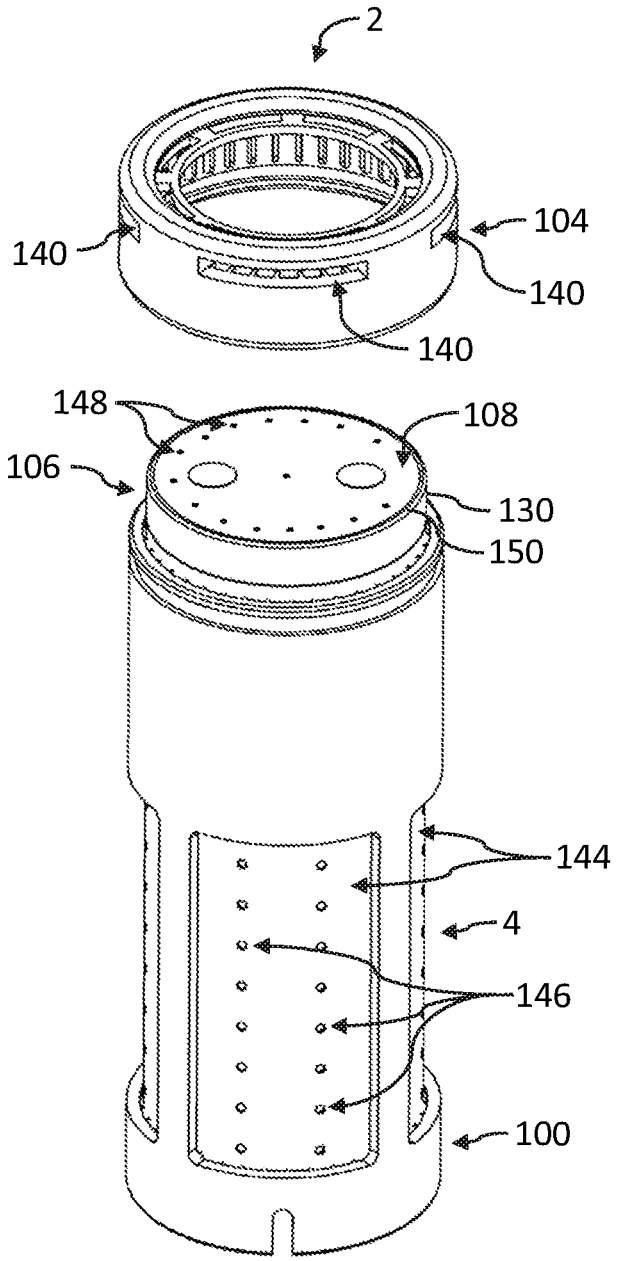
FIG. 3 illustrates a perspective view of the audio speaker device fully inserted into the cavity of the bottom cylindrical cap, according to some embodiments.
Figure 4:
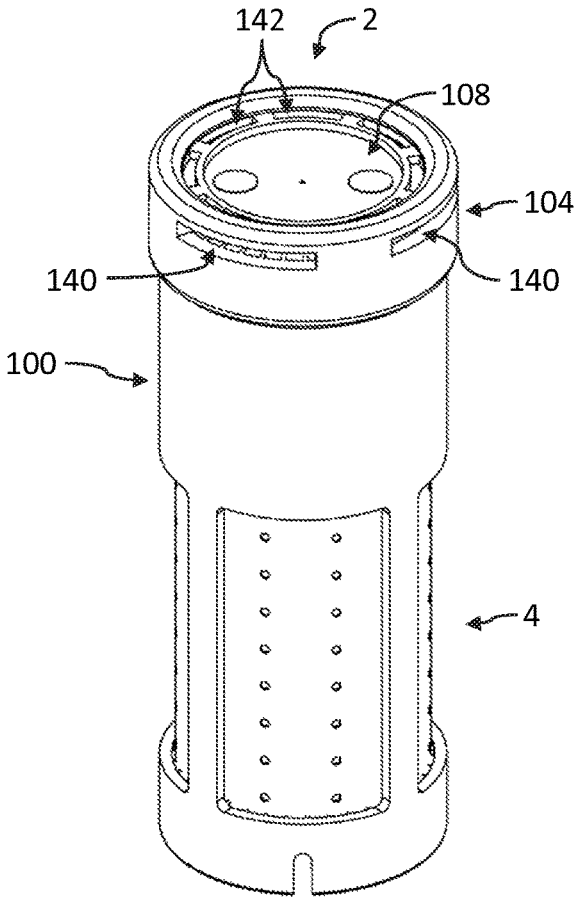
FIG. 4 illustrates a perspective view of the audio speaker device fully inserted into the cavity of the top cylindrical cap, according to some embodiments.
Figure 5:
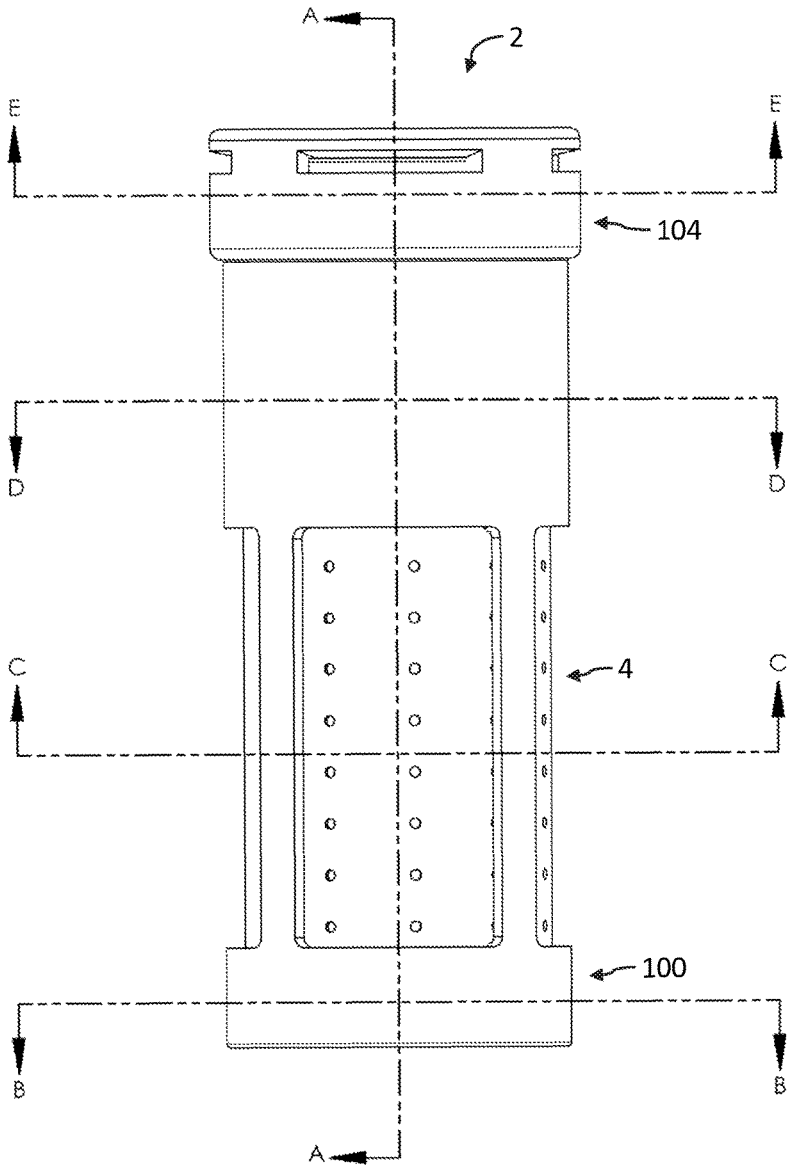
FIG. 5 illustrates a side view of the audio speaker device protected by the top and bottom caps while the top cap is rotatably coupled and removably coupled to the bottom cap such that the top cap can rotate relative to the bottom cap, according to some embodiments.

Referring now to FIGS. 3, 4 and 7, the top cylindrical cap 104 comprises radially outward holes 140 aligned with light emitting portions 150 of the speaker device 4.

Figure 2:
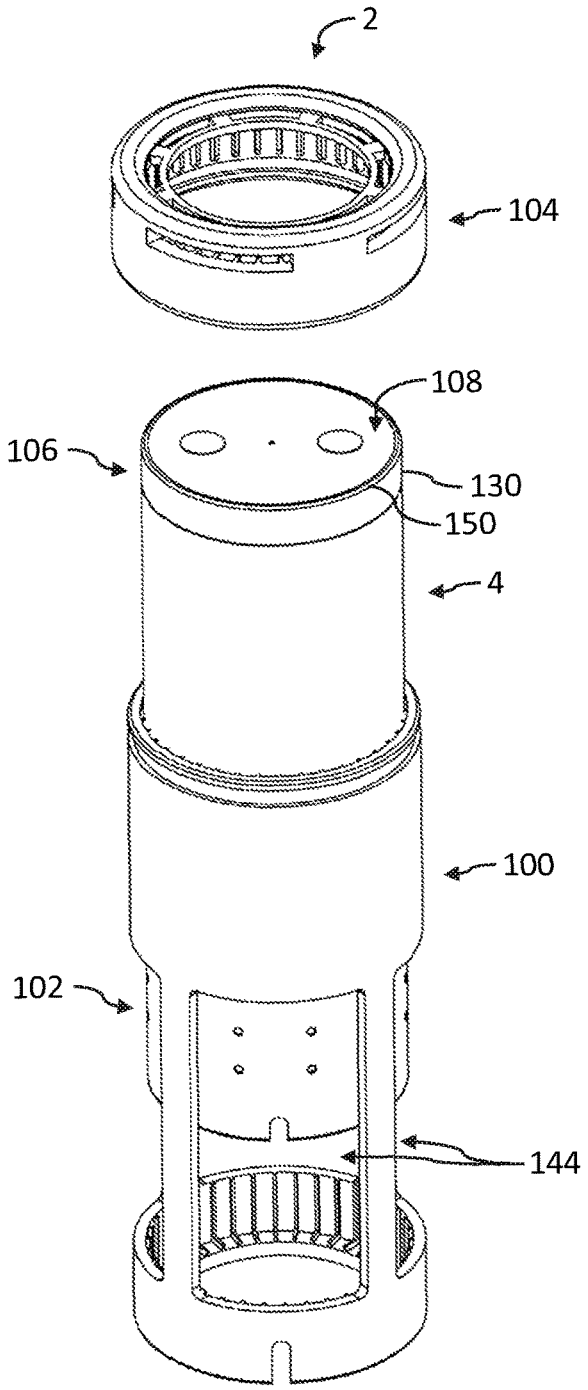
FIG. 2 illustrates a perspective view of a bottom end of the audio speaker device being inserted downward into a cavity of a bottom cylindrical cap, according to some embodiments.

Referring now to FIGS. 2-4, the top cylindrical cap 104 comprises upward facing holes 142 aligned with microphone holes 148 of the speaker device 4. The bottom cylindrical cap 100 comprises radially outward holes 144 aligned with speaker holes 146 of the speaker device 4. The speaker holes 146 are configured to emit sounds from the speaker device 4. (In the interest of clarity, not all holes are labeled in the Figures.)

Figure 28:
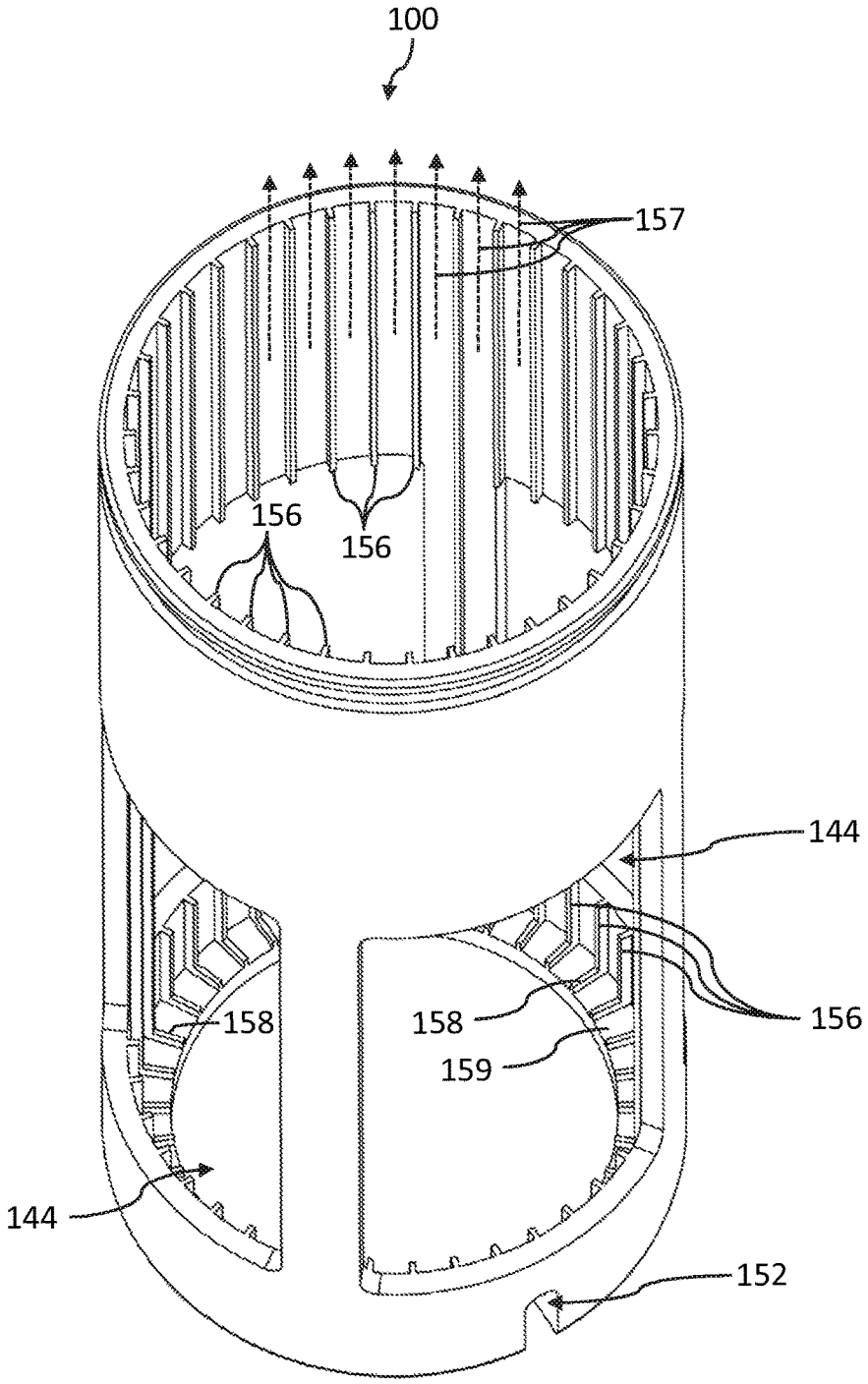
FIG. 28 illustrates a top and side perspective view of the bottom cylindrical cap (shown in FIG. 1) configured to protect the audio speaker device from falls, according to some embodiments.
Figure 29:
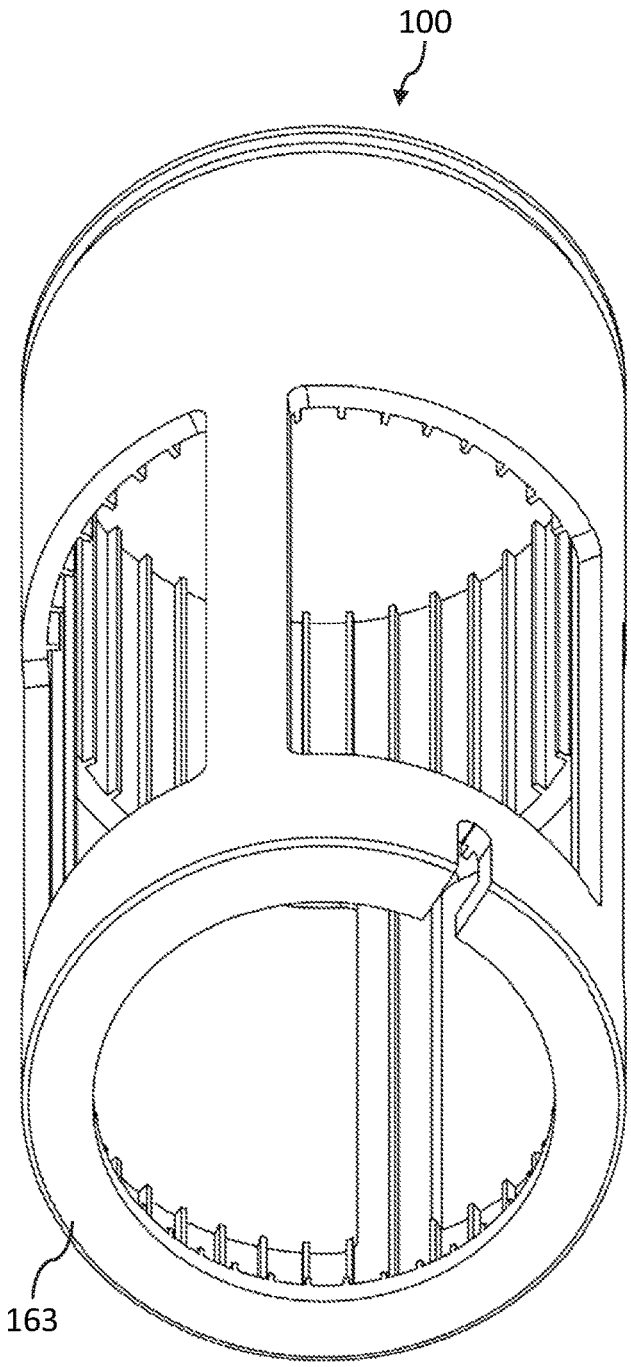
FIG. 29 illustrates a bottom and side perspective view of the bottom cylindrical cap, according to some embodiments.

Referring now to FIGS. 1 and 28, the bottom cylindrical cap 100 comprises a slot 152. The speaker device 4 is coupled to an electrical cable 6 configured to connect to a power outlet 8. The electrical cable 6 can exit the bottom cylindrical cap 100 through the slot 152.

As illustrated in FIGS. 1-32, the bottom cylindrical cap 100 can cover at least a portion of a bottom surface 161 (illustrated in FIG. 6) of the speaker device 4 such that the bottom cylindrical cap 100 is configured to resist upward dislodgement of the bottom cylindrical cap 100.

Referring now to FIG. 7, a rotatable coupling 125 can couple the top cylindrical cap 104 to the bottom cylindrical cap 100 such that the system 2 resists downward movement and upward movement relative to the speaker device 4.

Referring now to FIGS. 7, 17, 19, and 20, the top cylindrical cap 104 comprises a first outer ring 127, a second outer ring 129 coupled to a rotating dial 130 of the speaker device 4, and at least two vertical pillars 131 that couple the first outer ring 127 to the second outer ring 129. The first outer ring 127 is located above the second outer ring 129. The first outer ring 127 and the vertical pillars 131 are configured to absorb shock from the speaker device 4 falling onto portions of the first outer ring 127.

A third ring 133 is located radially inward from the first outer ring 127 and is coupled to the first ring by at least three radial protrusions 135 that form at least three holes 142 between the first ring 127 and the third ring 133. The third ring 133 is configured to secure the first ring 127 to the top surface 108 of the speaker device 4 while permitting the first ring 127 to deform radially to help absorb the shock from the speaker device 4 falling onto areas of the first outer ring 127.

Referring now to FIGS. 7, 20, 21, and 24-27, the top cylindrical cap 104 comprises at least three ribs 154 that protrude radially inward to provide an interference fit with the top portion 106 of the speaker device 4. The ribs 154 are configured such that coupling the top cylindrical cap 104 to the top portion 106 deforms the ribs 154 to create a compressive force that helps secure the top cylindrical cap 104 to the top portion 106.

The ribs 154 are coupled to a rotating dial 130 of the speaker device 4. The top cylindrical cap 104 extends downward below the rotating dial 130, but in some embodiments the ribs 154 do not contact an area below the rotating dial 130. The ribs 154 are oriented vertically and form ventilation channels 155 in fluid communication with radially outward holes 140 of the top cylindrical cap 104. The ventilation channels 155 are configured to enable ventilation of portions of a rotating dial 130 of the speaker device 4.

Figure 25:
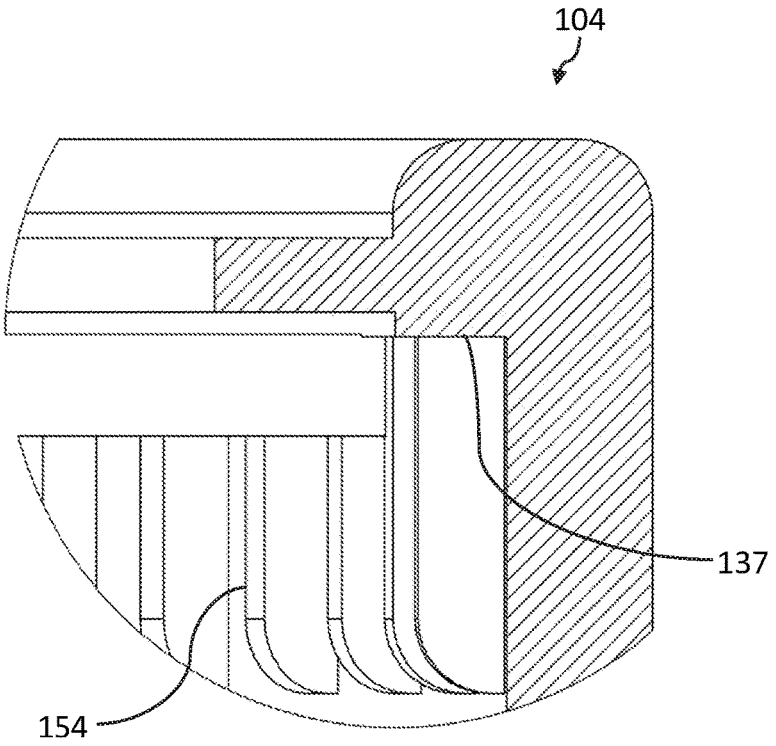
FIG. 25 illustrates a partial view of the area indicated by circle K in FIG. 24, according to some embodiments.
Figure 26:
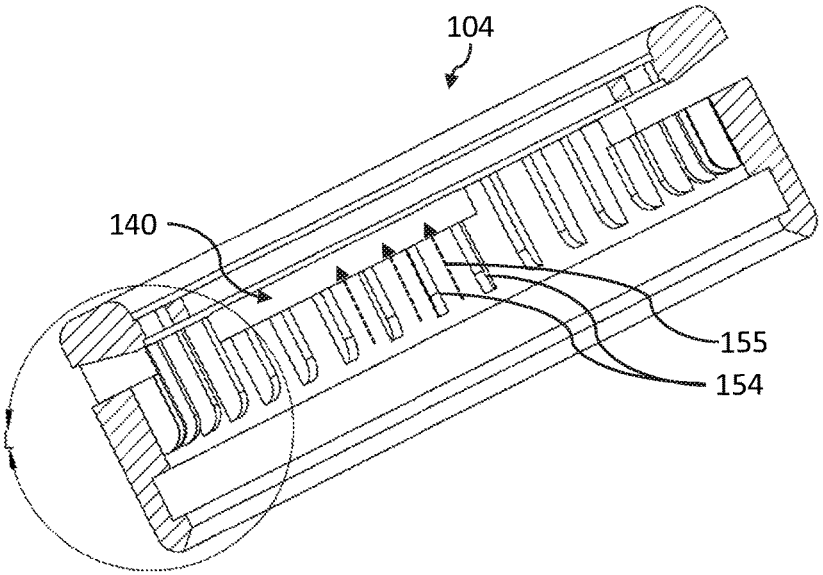
FIG. 26 illustrates a cross-sectional view along line J-J in FIG. 23, according to some embodiments.
Figure 27:
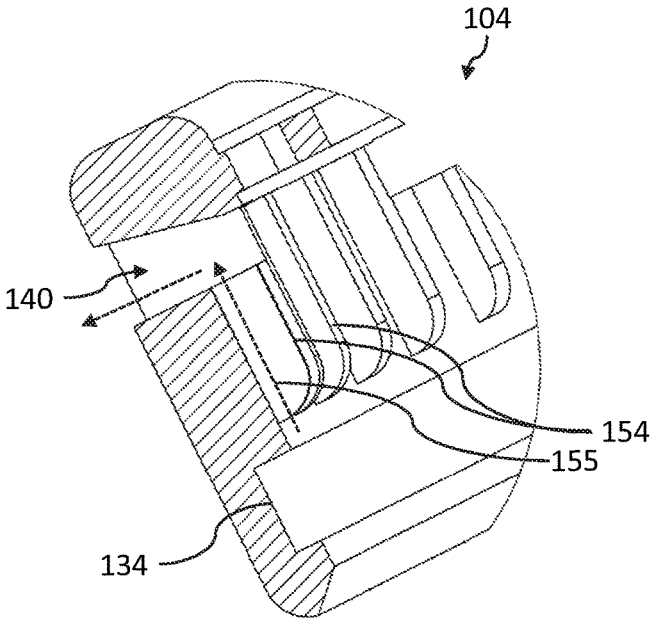
FIG. 27 illustrates a partial view of the area indicated by circle L in FIG. 26, according to some embodiments.

Referring now to FIGS. 1 and 25, a downward protrusion 137 that contacts less than an outer 4 millimeters of a perimeter of the top surface 108 such that the downward protrusion 137 is configured to impede the top cylindrical cap 104 from contacting a stationary portion of the top surface 108 while contacting a rotating dial 130 of the speaker device 4.

Referring now to FIG. 7, the radially outward holes 140 of the top cylindrical cap 104 are aligned with light emitting portions 150 of the speaker device 4. As used herein, holes are aligned if the presence of the hole causes the cap to not block the item. For example, the holes 140 do not block the applicable light emitting portions 150 shown in FIG. 7.

Referring now to FIGS. 2, 3, 8, and 28, the bottom cylindrical cap 100 comprises at least five ribs 156 that protrude radially inward to provide an interference fit with the bottom portion 102 of the speaker device 4. The ribs 156 are configured such that coupling the bottom cylindrical cap 100 to the bottom portion 102 deforms the ribs 156 to create a compressive force that helps secure the bottom cylindrical cap 100 to the bottom portion 102.

The ribs 156 are oriented vertically and form ventilation channels 157 in fluid communication with radially outward holes 144 of the bottom cylindrical cap 100. The ventilation channels 157 are configured to enable ventilation of portions of the bottom portion 102 of the speaker device 4. The radially outward holes 144 of the bottom cylindrical cap 100 are aligned with speaker holes 146 of the speaker device 4.

An upward facing surface 159 of the bottom cylindrical cap 100 comprises upwardly protruding ribs 158 configured to deform to absorb shock from the speaker device 4 falling onto portions of a bottom surface 163 of the bottom cylindrical cap 100.

Figure 30:
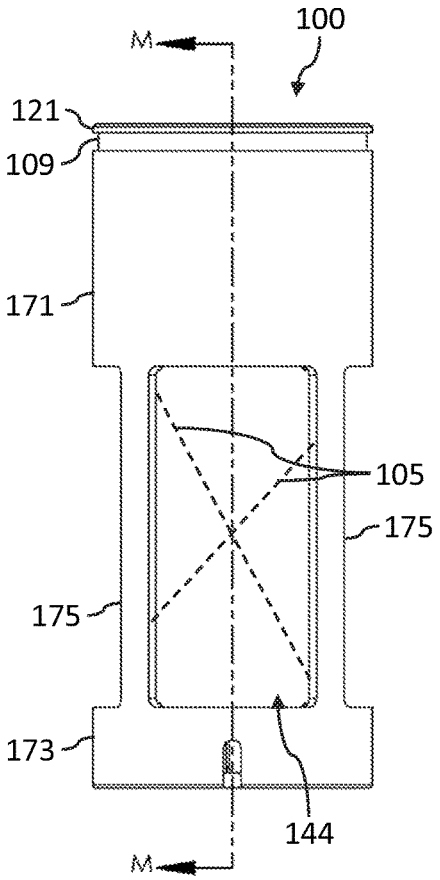
FIG. 30 illustrates a side view of the bottom cylindrical cap, according to some embodiments.
Figure 31:
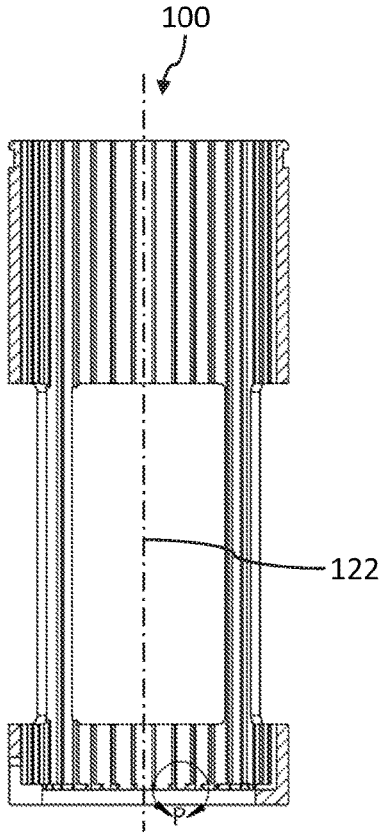
FIG. 31 illustrates a cross-sectional view along line M-M in FIG. 30, according to some embodiments.

Referring now to FIGS. 30-32, the bottom cylindrical cap 100 is at least four times taller than the top cylindrical cap 104 as measured vertically along central axes of the bottom and top caps. The bottom cylindrical cap 100 comprises an upper ring 171 and a lower ring 173 that are coupled by at least two protrusions 175 such that the upper ring 171 and the lower ring 173 are located at least 55 millimeters apart. The bottom cylindrical cap 100 comprises at least one radially outward hole 144 located between the upper ring 171, the lower ring 173, and the two protrusions 175. The radially outward hole 144 is aligned with speaker holes 146 of the speaker device 4 (as illustrated in FIG. 3).

The two protrusions 175 are at least 55 millimeters long. The bottom cylindrical cap 100 comprises at least one of trusses 105, beams, and webbing that couple the two protrusions 175 together to increase rotational stiffness of the bottom cylindrical cap 100 as measured by rotating the upper ring 171 relative to the lower ring 173.

FIGS. 33 to 39 illustrates a mount 200 that can hold the speaker device 4 while the speaker device 4 is inside the top cap 104 and the bottom cap 100 (as shown in FIG. 4). A bracket 202 can be screwed to a power outlet 8 and/or to a wall of a building. Then, the mount 200 can be slid down onto the bracket 202 (even if the power outlet 8 is oriented vertically or horizontally). Then, the power adapter 204 of the speaker device 4 can be plugged into the power outlet 8 while a portion of the bracket 202 is located between the power adapter 204 and the power outlet 8. Then, the cable 6 (shown in FIG. 1) can be storage inside the mount 200 as explained in U.S. Provisional Patent Application No. 62/294,452; entitled Cable Management Systems and Methods; and filed on Feb. 12, 2016. U.S. Provisional Patent Application No. 62/294,452 is incorporated by reference herein. Then, a lower portion of the speaker device 4 can be inserted into a cavity of the mount 200. The mount 200 can hide the cable 6 and/or the power adapter 204.

Figure 37:
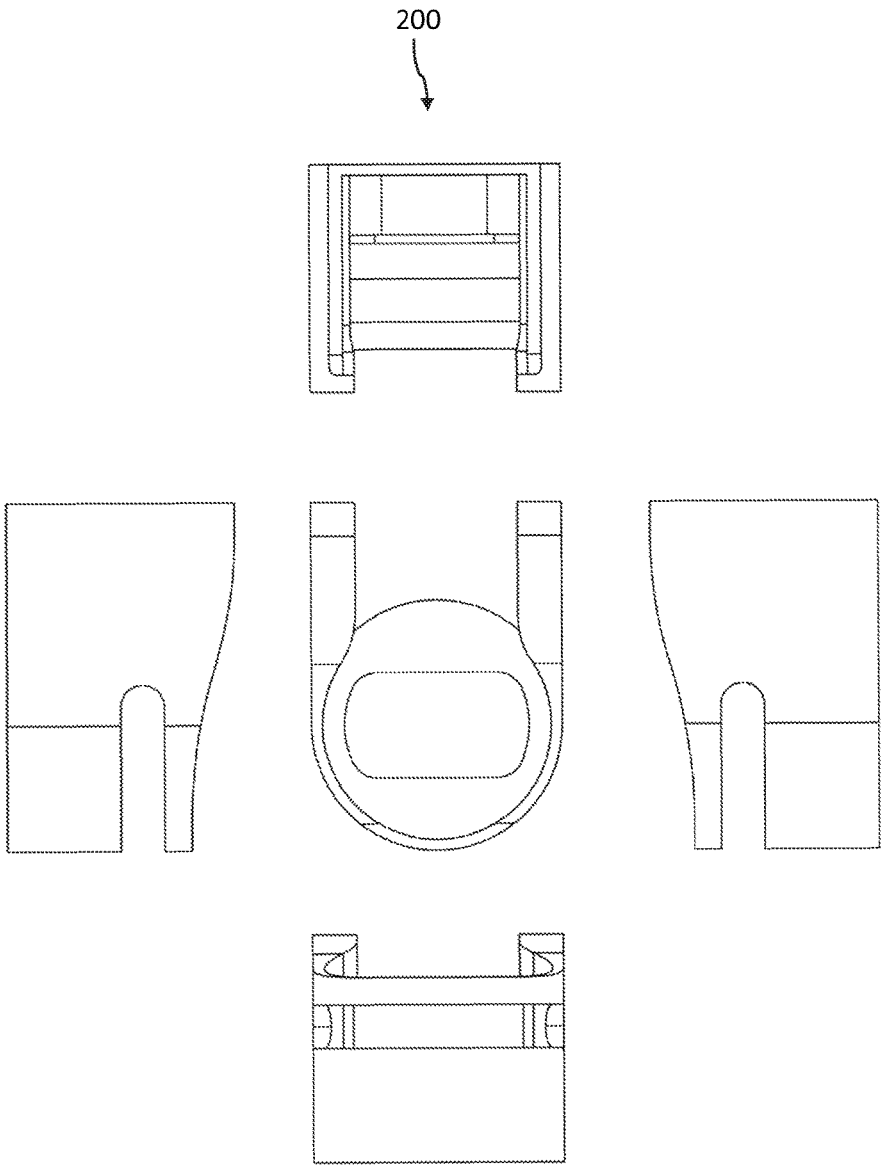
FIG. 37 illustrates top, front, back, and side views of a mount, according to some embodiments.
Figure 38:
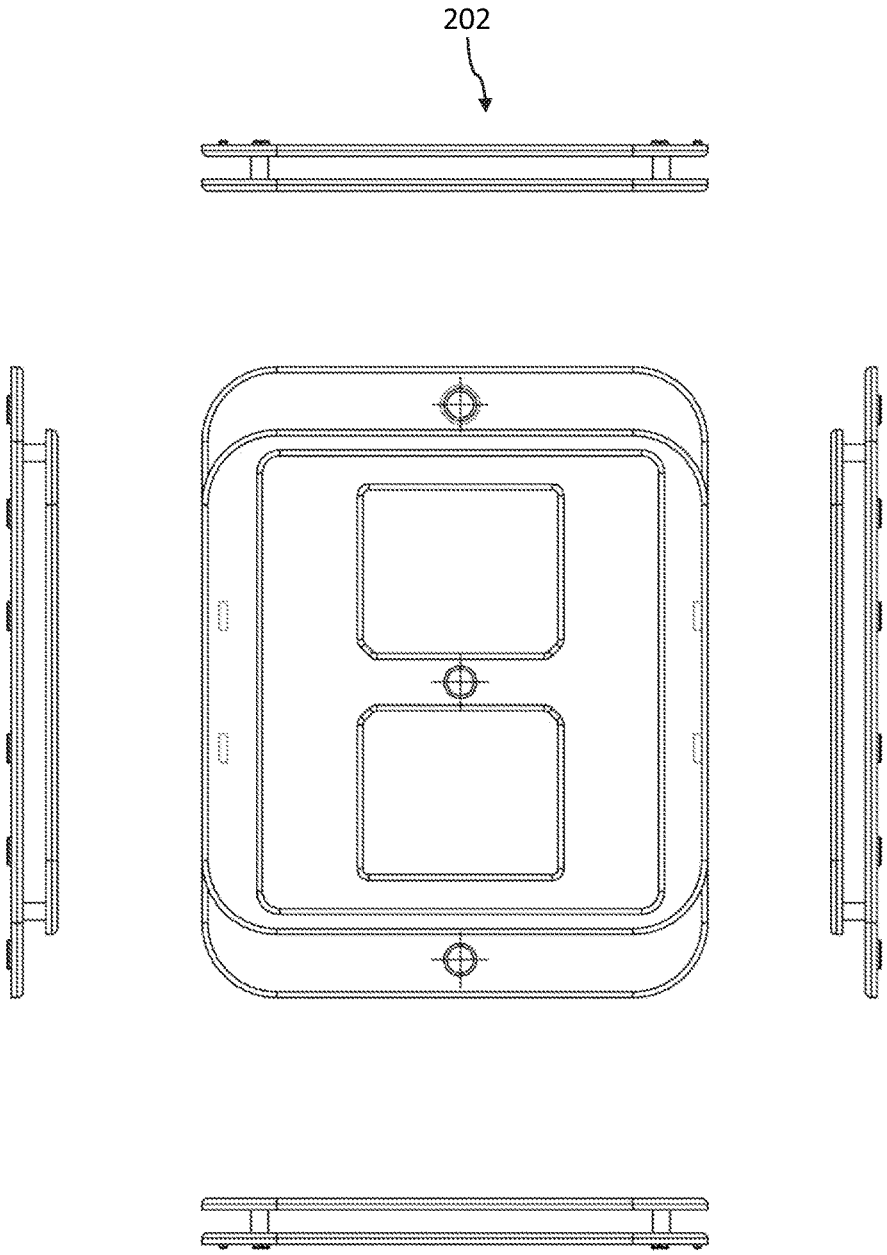
FIG. 38 illustrates front, side, top, and bottom views of a bracket, according to some embodiments.
Figure 39:
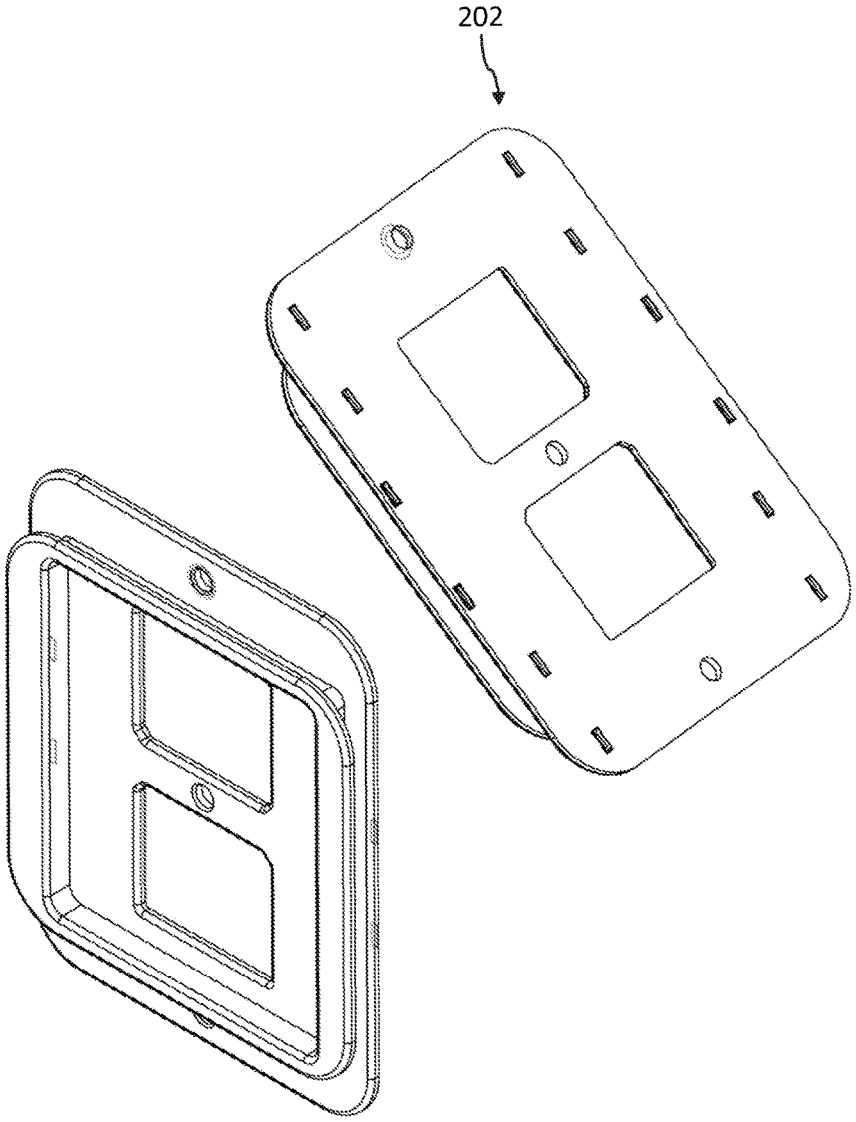
FIG. 39 illustrates perspective views of a bracket, according to some embodiments.

FIG. 37 illustrates top, side, front, and back views of the mount 200. FIG. 38 illustrates front, side, top, and bottom views of the bracket 202, which can have holes that match common screw locations of power outlets 8 and can have holes aligned with plug-ins of power outlets 8. FIG. 39 illustrates perspective views of the bracket 202.

Interpretation

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

I claim:

1. A speaker protection system configured to protect an audio speaker device from falls, the system comprising:

the speaker device;

a bottom cylindrical cap coupled to a bottom portion of the speaker device; and a top cylindrical cap coupled to a top portion of the speaker device, wherein the top cylindrical cap covers at least a portion of a top surface of the speaker device such that the top cylindrical cap is configured to resist downward dislodgement of the top cylindrical cap, wherein the bottom cylindrical cap is at least four times taller than the top cylindrical cap as measured vertically along central axes of the bottom and top caps, the bottom cylindrical cap comprises an upper ring and a lower ring that are coupled by at least two protrusions such that the upper ring and the lower ring are located at least 55 millimeters apart, and the bottom cylindrical cap comprises at least one radially outward hole located between the upper ring, the lower ring, and the two protrusions, wherein the radially outward hole is at least partially aligned with speaker holes of the speaker device.

2. The system of claim 1, wherein the bottom cylindrical cap is configured to resist movement relative to the bottom portion, the top cylindrical cap is configured to resist movement relative to the top portion, and the top cylindrical cap is rotatably coupled to the bottom cylindrical cap.

3. The system of claim 1, further comprising an interlock between the top cylindrical cap and the bottom cylindrical cap, wherein the interlock comprises a downward facing wall of the bottom cylindrical cap configured to block upward movement of the top cylindrical cap relative to the bottom cylindrical cap.

4. The system of claim 3, wherein the downward facing wall follows a 360 degree path around the central axis of the bottom cylindrical cap.

5. The system of claim 3, wherein the interlock comprises an upward facing wall of the top cylindrical cap, the downward facing wall faces the upward facing wall of the top cylindrical cap, and the interlock is configured such that the upward movement of the top cylindrical cap relative to the bottom cylindrical cap causes the upward facing wall to collide with the downward facing wall.

6. The system of claim 3, wherein the interlock is configured to removably couple the top cylindrical cap to the bottom cylindrical cap such that pulling the top cylindrical cap upward relative to the bottom cylindrical cap overcomes a holding force of the interlock, which causes elastic deformation of at least a portion of the top cylindrical cap relative to the bottom cylindrical cap to release the interlock.

7. The system of claim 1, wherein the top cylindrical cap is coupled to the bottom cylindrical cap by a snap fit comprising a radially outward protrusion and a radially inward protrusion such that at least a portion of the snap fit is configured to elastically deform in response to coupling the top cylindrical cap to the bottom cylindrical cap.

8. The system of claim 1, wherein the top cylindrical cap comprises a groove that faces radially inward, the bottom cylindrical cap comprises a radially outward protrusion located at least partially in the groove, and the top cylindrical cap is coupled to the bottom cylindrical cap by the groove and the radially outward protrusion.

9. The system of claim 1, wherein the top cylindrical cap comprises a first set of radially outward holes at least partially aligned with light emitting portions of the speaker device.

10. The system of claim 1, wherein the bottom cylindrical cap comprises at least three ribs that protrude radially inward to create an interference fit with the bottom portion of the speaker device, wherein the ribs are configured such that coupling the bottom cylindrical cap to the bottom portion deforms the ribs to create a compressive force that helps secure the bottom cylindrical cap to the bottom portion, wherein the ribs are oriented vertically and form ventilation channels in fluid communication with the at least one radially outward hole of the bottom cylindrical cap.

11. A speaker protection system configured to protect an audio speaker device from falls, the system comprising:

the speaker device;

a bottom cap coupled to a bottom portion of the speaker device; and a top cap coupled to a top portion of the speaker device, wherein the top cap is configured to cover at least a first portion of a top surface of the speaker device, wherein the top cap is coupled to the bottom cap by an interlock comprising a downward facing wall of the bottom cap and an upward facing wall of the top cap such that the downward facing wall is configured to block upward movement of the upward facing wall, wherein the top cap comprises a first outer ring, a second outer ring coupled to the top portion of the speaker device, and at least two vertical protrusions that couple the first outer ring to the second outer ring, wherein the first outer ring is located upward relative to the second outer ring, and the first outer ring and the vertical protrusions are configured to absorb shock from the speaker device falling onto portions of the first outer ring.

12. The system of claim 11, wherein the downward facing wall follows a first 360 degree path around a first central axis of the bottom cap, the upward facing wall follows a second 360 degree path around a second central axis of the top cap, and the bottom cap is configured to cover at least a portion of a bottom surface of the speaker device.

13. The system of claim 11, wherein the top cap comprises a third ring that is located radially inward from the first outer ring, wherein the third ring is coupled to the first outer ring by at least two radial protrusions that form at least two holes between the first outer ring and the third ring.

14. The system of claim 11, wherein the top cap comprises a downward protrusion that contacts at least 0.01 millimeters and less than 6 millimeters of an outer perimeter of a rotating dial of the speaker device such that the downward protrusion impedes the top cap from contacting a stationary portion of the top surface while the downward protrusion contacts the rotating dial of the speaker device.

15. The system of claim 14, wherein the top cap extends downward below the rotating dial but does not contact an area below the rotating dial.

16. A speaker protection system configured to protect an audio speaker device from falls, the system comprising:

the speaker device;

a bottom cylindrical cap coupled to a bottom portion of the speaker device; and a top cylindrical cap coupled to a top portion of the speaker device, wherein the top cylindrical cap covers at least a portion of a top surface of the speaker device such that the top cylindrical cap is configured to resist downward dislodgement of the top cylindrical cap, wherein the top cylindrical cap comprises at least three ribs that protrude radially inward creating an interference fit with the top portion of the speaker device, wherein the ribs are configured such that coupling the top cylindrical cap to the top portion deforms the ribs to create a compressive force that helps secure the top cylindrical cap to the top portion of the speaker device.

17. The system of claim 16, further comprising a downward protrusion that contacts at least 0.01 millimeters and less than 4 millimeters of an outer perimeter of a top of the top portion of the speaker device.

18. The system of claim 16, wherein the top cylindrical cap comprises radially outward holes that are at least partially aligned with light emitting portions of the top portion.

* * * * *